US009089731B2

(12) United States Patent
King et al.

(10) Patent No.: US 9,089,731 B2
(45) **Date of Patent: *Jul. 28, 2015**

(54) PLAY SYSTEMS HAVING MULTIPLE CURVED STRUCTURAL MEMBERS

(71) Applicant: Landscape Structures Inc., Delano, MN (US)

(72) Inventors: Steven G. King, Maple Plain, MN (US); Thomas L. Keller, Delano, MN (US)

(73) Assignee: Landscape Structures Inc., Delano, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/917,707

(22) Filed: Jun. 14, 2013

(65) Prior Publication Data

US 2014/0155184 A1 Jun. 5, 2014

Related U.S. Application Data

(63) Continuation of application No. 12/712,524, filed on Feb. 25, 2010, now Pat. No. 8,485,911, which is a continuation of application No. 11/827,851, filed on Jul. 13, 2007, now Pat. No. 8,366,562.

(60) Provisional application No. 60/831,010, filed on Jul. 14, 2006.

(51) Int. Cl.
*A63B 9/00* (2006.01)
*A63B 17/00* (2006.01)

(52) U.S. Cl.
CPC . *A63B 9/00* (2013.01); *A63B 17/00* (2013.01); *A63B 2009/002* (2013.01); *A63B 2009/004* (2013.01)

(58) Field of Classification Search
CPC ..... A63B 9/00
USPC ..... 472/136
See application file for complete search history.

(56) References Cited

U.S. PATENT DOCUMENTS 3,601,397 A * 8/1971 Carlin et al. ..... 482/36
4,003,167 A 1/1977 Saunders (Continued)

FOREIGN PATENT DOCUMENTS

CA 2658420 A1 1/2008

OTHER PUBLICATIONS

Issue Notification dated in Jan. 16, 2013 in related U.S. Appl. No. 11/827,851, filed Jul. 13, 2007, 1 page.

(Continued)

*Primary Examiner* — Michael Dennis
(74) *Attorney, Agent, or Firm* — Katherine M. Scholz; Kelly, Holt & Christenson, PLLC

(57) ABSTRACT

Embodiments of play systems having multiple curved structural members are disclosed. Play systems illustratively include a first quarter of an ellipse, a second quarter of an ellipse, a third quarter of an ellipse, and a fourth quarter of an ellipse. Each ellipse quarter has first and second ends. The first, the second, the third, and the fourth ellipse quarters are oriented approximately vertically relative to a surface such that the first ends of the ellipse quarters contact the surface and the second ends of the ellipse quarters are above the surface. The first ends of the ellipse quarters are optionally spaced further apart from each other than the second ends of the ellipse quarters.

8 Claims, 44 Drawing Sheets

(56) References Cited

U.S. PATENT DOCUMENTS

| | | | | |
|---|---|---|---|---|
| 4,046,375 | A | | 9/1977 | Lelong |
| 4,084,812 | A | | 4/1978 | Melrose et al. |
| 4,497,484 | A | | 2/1985 | West |
| 4,583,331 | A | | 4/1986 | Hunt et al. |
| 4,630,819 | A | | 12/1986 | Levin |
| D361,116 | S | | 8/1995 | Shaneour |
| 6,095,950 | A | | 8/2000 | Katz |
| 6,929,478 | B1 | | 8/2005 | Spencer et al. |
| D515,166 | S | | 2/2006 | Montfort |
| D554,227 | S | * | 10/2007 | Yates et al. ..... D21/826 |
| 8,021,240 | B2 | | 9/2011 | King |
| 8,366,562 | B2 | | 2/2013 | King |
| 8,485,911 | B2 | | 7/2013 | King et al. |
| 2004/0266312 | A1 | | 12/2004 | Oren et al. |
| 2013/0157771 | A1 | | 6/2013 | King et al. |

OTHER PUBLICATIONS

Notice of Allowance dated Oct. 5, 2012 in related U.S. Appl. No. 11/827,851, filed Jul. 13, 2007, 9 pages.

Decision of Appeal dated Sep. 19, 2012 in related U.S. Appl. No. 11/827,851, filed Jul. 13, 2007, 9 pages.

Issue Notification dated Jun. 26, 2013 in related U.S. Appl. No. 12/712,524, filed Feb. 25, 2010, 1 page.

Issue Notification dated Aug. 31, 2011 in related U.S. Appl. No. 12/435,834, filed May 5, 2009, 1 page.

Official Action dated Aug. 21, 2008 in related U.S. Appl. No. 11/827,851, filed Jul. 13, 2007, 7 pgs.

Final Office Action dated Jan. 9, 2009 in related U.S. Appl. No. 11/827,851, filed Jul. 13, 2007, 12 pgs.

Appeal Brief filed Jul. 29, 2009 in related U.S. Appl. No. 11/827,851, filed Jul. 13, 2007, 47 pgs.

Examiner's Answer to Appeal Brief dated Sep. 18, 2009 in related U.S. Appl. No. 11/827,851, filed Jul. 13, 2007, 20 pgs.

Reply Brief filed Nov. 16, 2009 in related U.S. Appl. No. 11/827,851, filed Jul. 13, 2007, 6 pgs.

Notice of Allowance dated Jun. 10, 2011 in related U.S. Appl. No. 12/435,834, filed May 5, 2009, now Patent No. 8,021,240, issued Sep. 20, 2011, 7 pgs.

Final Office dated Nov. 9, 2011 in related U.S. Appl. No. 12/712,524, filed Feb. 25, 2010, 14 pgs.

Office Action dated Apr. 4, 2011 in related U.S. Appl. No. 12/712,524, filed Feb. 25, 2010, 11 pgs.

Notice of Allowance dated Mar. 14, 2013, for related U.S. Appl. No. 12/712,524, filed Feb. 25, 2010, 7 pgs.

Notice of Allowance dated Sep. 17, 2012 for U.S. Appl. No. 12/712,524, filed Feb. 25, 2010, 7 pgs.

Office Action dated Dec. 23, 2010, in U.S. Appl. No. 12/435,834, filed May 5, 2009, 12 pgs.

* cited by examiner

PLAY SYSTEMS HAVING MULTIPLE CURVED STRUCTURAL MEMBERS

REFERENCE TO RELATED CASES

The present application is a continuation of U.S. patent application Ser. No. 12/712,524, filed Feb. 25, 2010 which is a continuation of U.S. patent application Ser. No. 11/827,851, filed Jul. 13, 2007, now U.S. Pat. No. 8,366,562, issued Feb. 5, 2013, which is based on and claims the benefit of U.S. provisional patent application Ser. No. 60/831,010, filed Jul. 14, 2006, the content of which is hereby incorporated by reference in its entirety

BACKGROUND

The focus of most current playground play systems is typically centered upon some type of large "post and deck" structure. In general, these systems promote "continuous play" to some extent, for example, where an individual can move from one play element to the next, possibly without ever touching the ground. However, it is typical that there are limited options for traversing from one play element to the next. The possible routes from element to element are often predetermined or even restricted. The design rarely encourages individuals to use their imagination in determining what path to take between elements.

One implication of the limitations of current play systems is that they tend to be perceived by older aged kids as being boring or otherwise unappealing. Also, the systems are not very effective in terms of encouraging activities that promote health without sacrificing fun.

SUMMARY

An aspect of the disclosure relates to play systems having multiple curved structural members. In one embodiment, play systems include a first quarter of an ellipse, a second quarter of an ellipse, a third quarter of an ellipse, and a fourth quarter of an ellipse. Each ellipse quarter has first and second ends. The first, the second, the third, and the fourth ellipse quarters are oriented approximately vertically relative to a surface such that the first ends of the ellipse quarters contact the surface and the second ends of the ellipse quarters are above the surface. The first ends of the ellipse quarters are illustratively spaced further apart from each other than the second ends of the ellipse quarters.

These and various other features and advantages that characterize the claimed embodiments will become apparent upon reading the following detailed description and upon reviewing the associated drawings.

DETAILED DESCRIPTION

Figure 1:
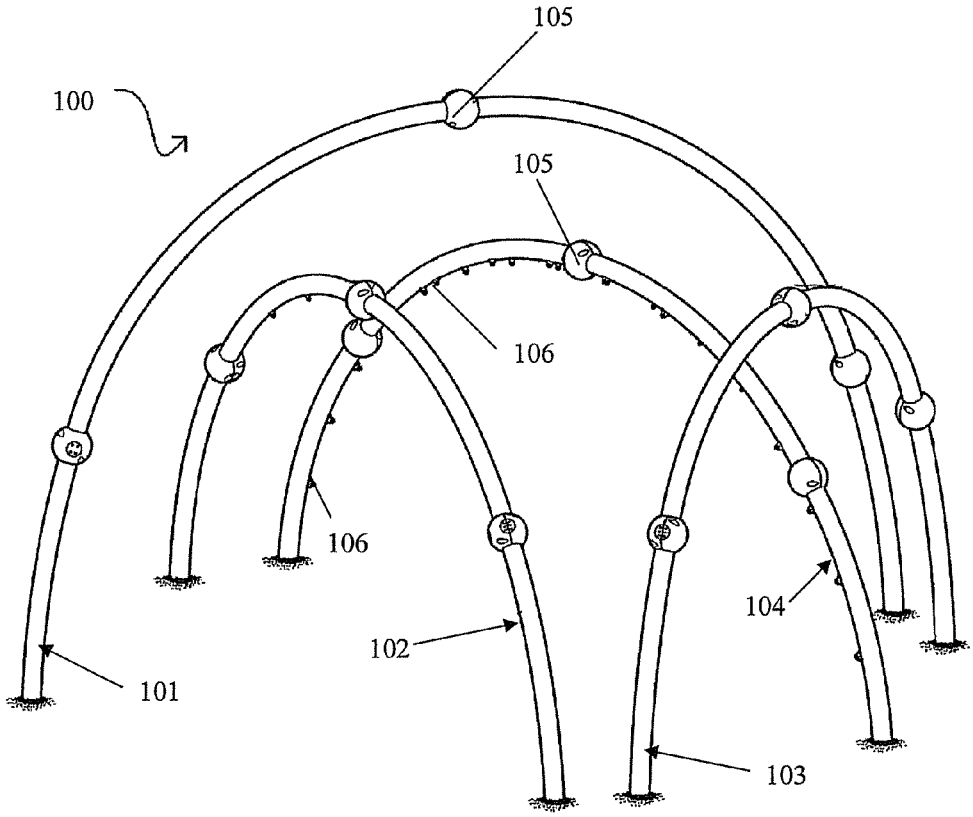
FIG. 1 is a perspective view of an arch-based play system.

FIG. 1 is a perspective view of an arch-based play system 100. System 100 includes arch assemblies 101, 102, 103, and 104. System 100 also includes a plurality of arch clamps 105 (an illustrative two are identified in FIG. 1). Also included are a plurality of arch tabs 106 (an illustrative two are identified in FIG. 1).

Before proceeding further into the present description, it is worth noting that the terms "arch" and "arch assembly" as used herein are not necessarily limited to an upwardly curved structures as shown in FIG. 1. Those skilled in the art will appreciate that similar over arching structures can be utilized even if such structures do not have a continuous uninterrupted curvature. The illustrated embodiment is one example of the type of structure that is to be considered within the scope of the present invention.

As will become apparent, system 100 is modular in that a wide variety of different play elements can be incorporated into the arch-based environment. Depending upon a connection scheme necessary to support the components of a given implementation, arch tabs 106 may or may not be included in system 100, and may be located within the system in locations other than their positions illustrated in FIG. 1. Further, as will become apparent, the precise configuration of arch clamps 105 may vary depending on the component attachment details associated with a given implementation.

Figure 2:
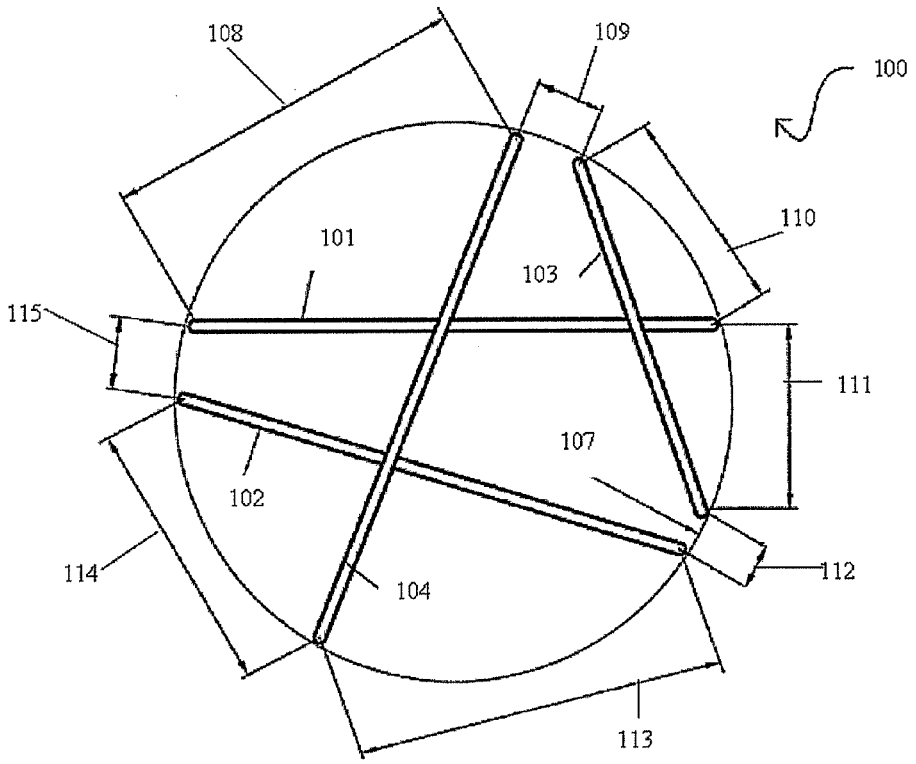
FIG. 2 is a top plan view of the arch-based play system.

FIG. 2 is a top plan view of arch-based play system 100. It should be noted that all dimensions provided herein are intended to be illustrative only. Specific dimensions are provided as an example of scale and are not intended to limit the scope of the present invention in any way. Those skilled in the art will appreciate that the dimensions can easily be adjusted without departing from the scope of the present invention.

It should also be pointed out that the positioning of arches relatively to one another as shown and described herein is also illustrative only. A specific configuration is provided as an example of the concept and is not intended to limit the scope of the present invention in any way. Those skilled in the art will appreciate that the arches can easily be otherwise configured without departing from the scope of the present invention.

As is shown in FIG. 2, the ends of arch assemblies 101, 102, 103, and 104 are all positioned in substantial alignment with the circumference of an imaginary circle 107. Of course, this need not necessarily be the case. The end of one or more arches could just as easily be outside of a common circumference without departing from the scope of the present invention. In one embodiment, certainly not by limitation, the diameter of circle 107 is 40 feet and 10 inches.

In one embodiment, certainly not by limitation, a distance 108 between one end of arch assembly 101 and one end of arch assembly 104 is 164 and 13/16inches. In one embodiment, certainly not by limitation, the distance 109 between one end of arch assembly 104 and one end of arch assembly 103 is 31 and 11/16inches. In one embodiment, certainly not by limitation, the distance 110 between one end of arch assembly 103 and one end of arch assembly 101 is 93 and 3/16inches. In one embodiment, certainly not by limitation, the distance 111 between one end of arch assembly 101 and one end of arch assembly 103 is 80 and 7/8inches. In one embodiment, certainly not by limitation, the distance 112 between one end of arch assembly 103 and one end of arch assembly 102 is 22 and 7/16inches. In one embodiment, certainly not by limitation, the distance 113 between one end of arch assembly 102 and one end of arch assembly 104 is 165 and 3/4inches. In one embodiment, certainly not by limitation, the distance 114 between one end of arch assembly 104 and one end of arch assembly 102 is 119 and 3/16inches. In one embodiment, certainly not by limitation, the distance 115 between one end of arch assembly 102 and one end of arch assembly 101 is 33 and 5/8inches.

It is worth emphasizing yet again the modular and adaptable nature of system 100. The system shown in the Figures is but one of a great number of possible configurations within the scope of the present invention. Configurations can include any number of arch assemblies, and the arch assemblies can be spaced apart as desired. It is also worth mentioning that a beneficial feature of system 100 is that the arch-based system can be expanded in phases by starting with one or more arch assemblies and then adding additional arch assemblies after an initial arch-based play system has been formed. As will become apparent, play elements can be incorporated into the initial system and/or added during any subsequent phase of expansion of the system. In one embodiment, the FIG. 2 distances 109, 112, and 115 are such that they create a "modular opening" or "attachment point" where play elements can be attached.

Figure 3:
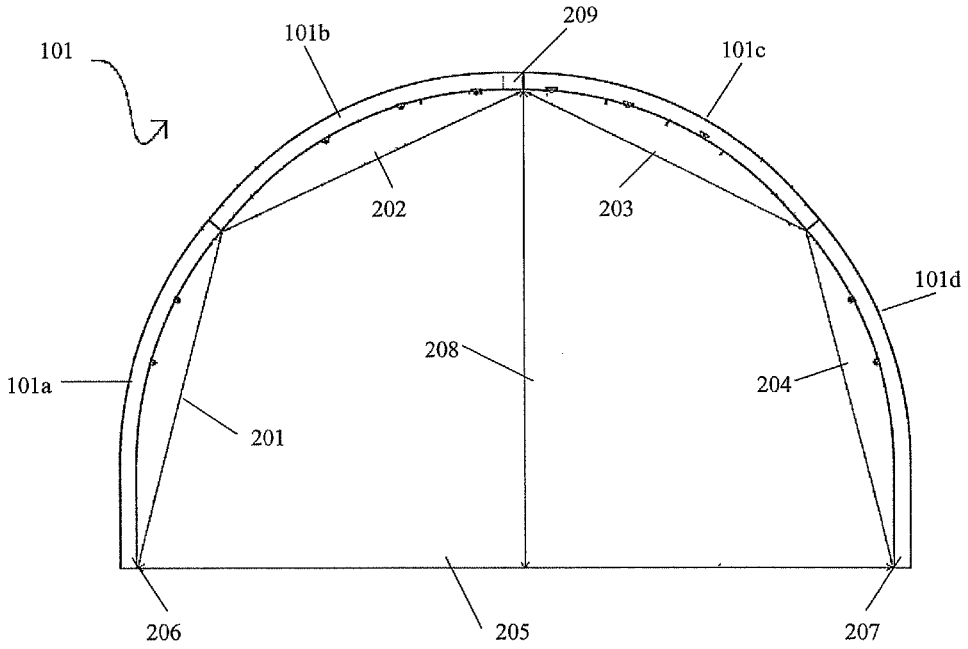
FIGS. 3-6 are side views of arch assemblies.

FIG. 3 is a side view of arch assembly 101. In this case, clamps 105 have been excluded to show that the arch assembly is actually comprised of separate segments. In one embodiment, one function of clamps 105 is to conceal a connection between segments of the overall assembly. Arch assembly 101 includes segments 101*a*, 101*b*, 101*c*, and 101*d*. In one embodiment, not by limitation, segment 101*a* has an end-to-end linear distance 201 of approximately 103.5 inches, segment 101*b* has an end-to-end linear distance 202 of approximately 98.75 inches, segment 101*c* has an end-to-end linear distance 203 of approximately 93.5 inches, and segment 101*d* has an end-to-end linear distance 204 of approximately 103.5 inches. Also in one embodiment, not by limitation, the distance 205 between the first end of the arch assembly 206 and the second end of the arch assembly 207 is 230 inches, and the distance 208 between the top of the arch assembly 209 and the bottom of the arch assembly is 105 inches. Although arch assembly 101 is illustrated as including four segments, arch assemblies need not be so limited. An arch assembly can include only one piece (i.e. not segmented), two segments, three segments, four segments (as is shown in FIG. 3), or any number of segments.

Figure 4:
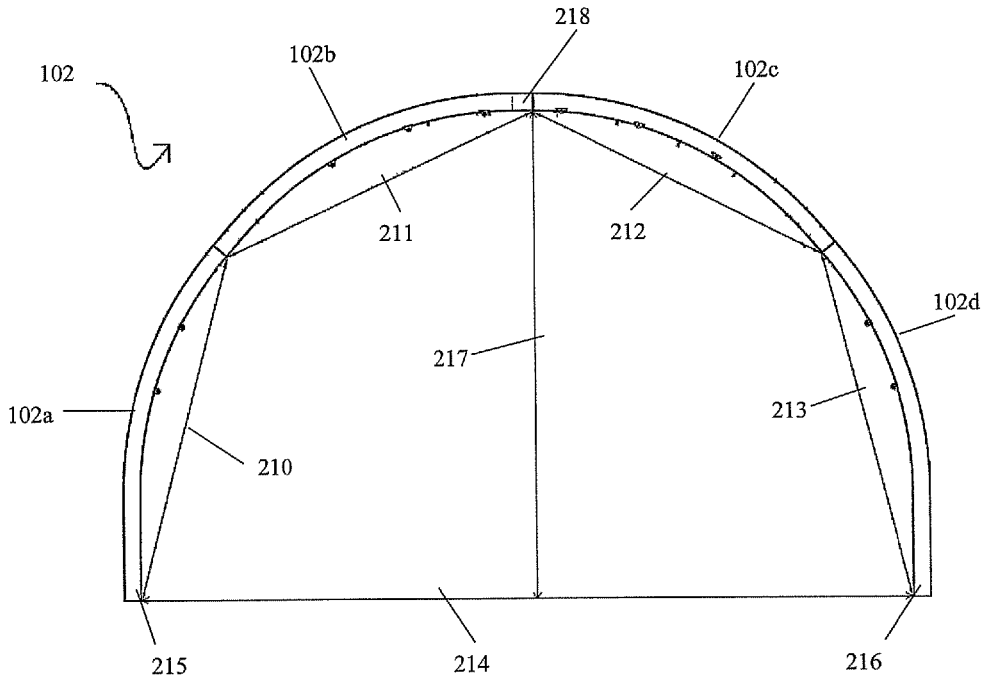

FIG. 4 is a side view of arch assembly 102. In this case, clamps 105 have again been excluded. Arch assembly includes segments 102*a*, 102*b*, 102*c*, and 102*d*. In one embodiment, not by limitation, segment 102*a* has an end-to-end linear distance 210 of approximately 103.5 inches, segment 102*b* has an end-to-end linear distance 211 of approximately 98.75 inches, segment 102*c* has an end-to-end linear distance 212 of approximately 93.5 inches, and segment 102*d* has an end-to-end linear distance 213 of approximately 103.5 inches. Also in one embodiment, not by limitation, the distance 214 between the first end of the arch assembly 215 and the second end of the arch assembly 216 is 230 inches, and the distance 217 between the top of the arch assembly 218 and the bottom of the arch assembly is 105 inches.

Figure 5:
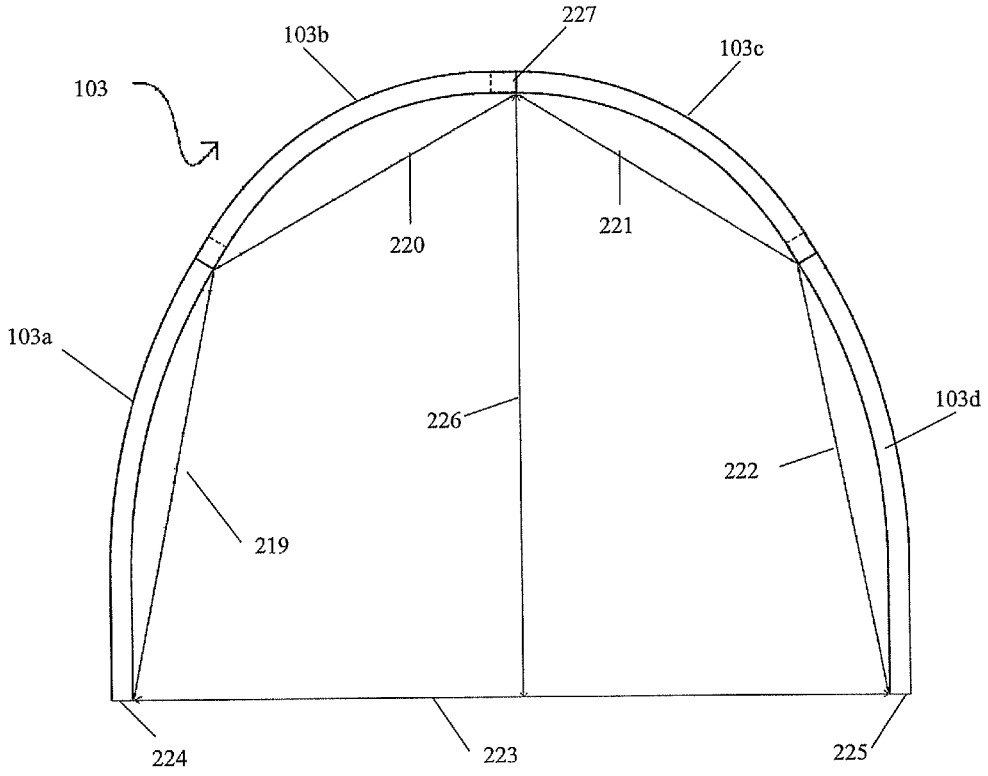

FIG. 5 is a side view of arch assembly 103. In this case, clamps 105 have again been excluded. Arch assembly 103 includes segments 103*a*, 103*b*, 103*c*, and 103*d*. In one embodiment, not by limitation, segment 103*a* has an end-to-end linear distance 219 of approximately 103.5 inches, segment 103*b* has an end-to-end linear distance 220 of approximately 80.5 inches, segment 103*c* has an end-to-end linear distance 221 of approximately 75 inches, and segment 103*d* has an end-to-end linear distance 222 of approximately 103.25 inches. Also in one embodiment, not by limitation, the distance 223 between the first end of the arch assembly 224 and the second end of the arch assembly 225 is 163 inches, and the distance 226 between the top of the arch assembly 227 and the bottom of the arch assembly is 111 inches.

Figure 6:
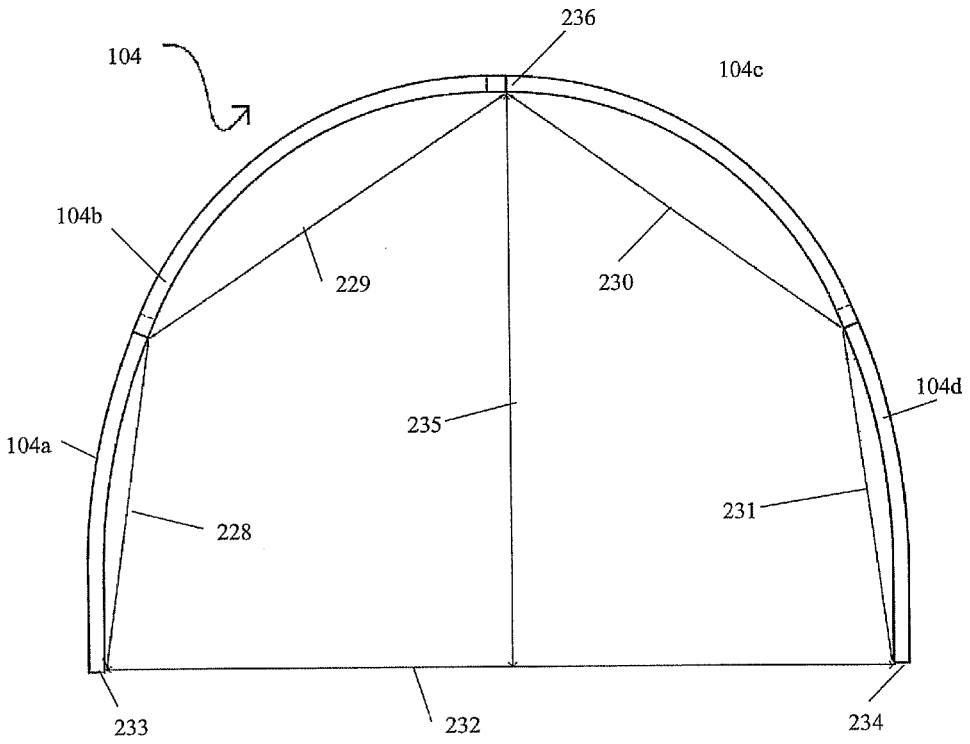

FIG. 6 is a side view of arch assembly 104. Arch assembly 104 includes segments 104*a*, 104*b*, 104*c*, and 104*d*. In one embodiment, not by limitation, segment 104*a* has an end-to-end linear distance 228 of approximately 104.5 inches, segment 104*b* has an end-to-end linear distance 229 of approximately 135.5 inches, segment 104*c* has an end-to-end linear distance 230 of approximately 130.5 inches, and segment 104*d* has an end-to-end linear distance 231 of approximately 104.5 inches. Also in one embodiment, not by limitation, the distance 232 between the first end of the arch assembly 233 and the second end of the arch assembly 234 is 237 inches, and the distance 235 between the top of the arch assembly 236 and the bottom of the arch assembly is 147 inches.

In one embodiment, not by limitation, arch assemblies 101, 102, 103, and 104 are manufactured from galvanized steel tubing. Those skilled in the art will appreciate that other materials can be utilized without departing from the scope of the present invention. In one embodiment, not by limitation, arch assemblies 101, 102, 103, and 104 have an outer diameter of approximately 5 inches and a wall thickness of approximately 0.120 inches. The cut ends of the steel tubing are illustratively sprayed with a corrosion resistant coating and the exterior surfaces of the arches are illustratively provided with some sort of a finishing coating, such as a powdercoat finishing. It should also be noted that the arch assembly first end to second end distances such as 205, 214, 223, and 232 can be varied from the stated distances. In one embodiment, the end to end distances of the arch assemblies are spaced apart by a distance of at least six feet.

In one embodiment, all of the bottom arch segments such as 201, 204, 210, 213, 219, 222, 228, and 231 are the same or similar length despite differences in overall height and lengths of the arch assemblies. This allows for arch clamps to cover the seams of the arch assemblies at approximately the same height. This also facilitates attaching a play element to more than one arch assembly.

Figure 7:
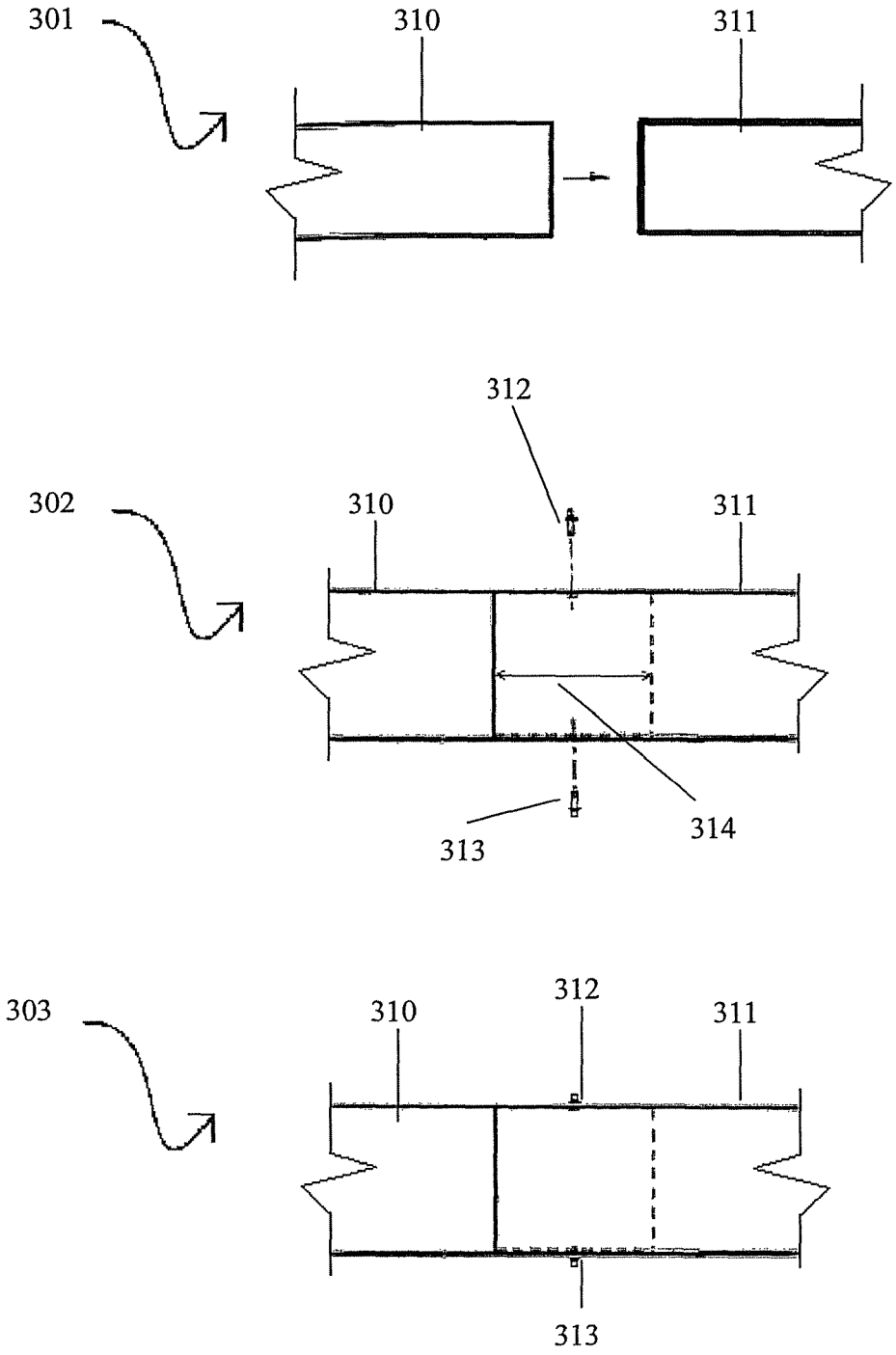
FIG. 7 is a schematic flow diagram of an attachment scheme for connecting adjoining arch assembly segments.

FIG. 7 is a schematic flow diagram demonstrating one embodiment of an attachment scheme for connecting adjoining arch assembly segments. In step 301, the end of one arch segment 310 and the end of another arch segment 311 are not attached. In step 302, end 310 that has an outer-diameter that is smaller than the inner-diameter of end 311, is partially inserted into end 311 in such a way that a certain portion of 310 represented by the distance 314 in encased by 311. Also in step 302, preparation is made to connect ends 310 and 311 with rivets 312 and 313. In step 303, rivets 312 and 313 have been driven through the overlapping section 314 and the arch segments are attached. In one embodiment, this or a similar method of attaching adjoining arch assembly segments is employed to attach all adjoining segments shown in FIGS. 3-6.

Figure 8A:
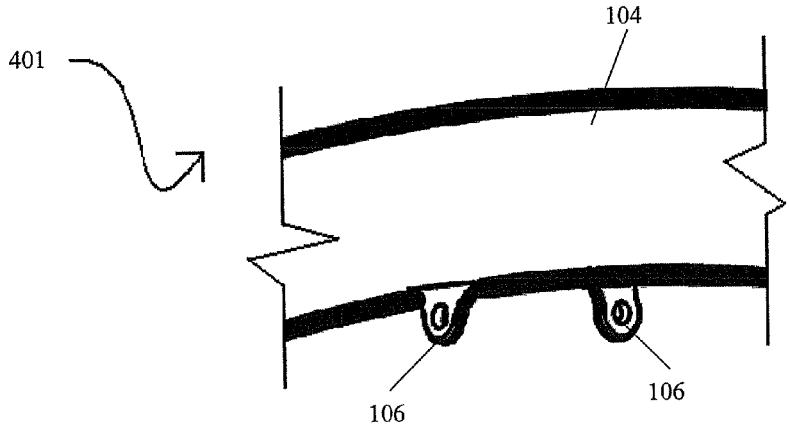
FIG. 8A is a close up side view of a portion of an arch assembly.

FIG. 8A is a close up side view of a portion 401 of arch assembly 104 (FIG. 1). Arch tabs 106 are attached to portion 401 and are configured to receive an attachment mechanism, such as a mechanism associated with a play element. Multiple (e.g., two) arch tabs located in relatively close proximity to one another illustratively constitute a set 421 of arch tabs.

Figure 8B:
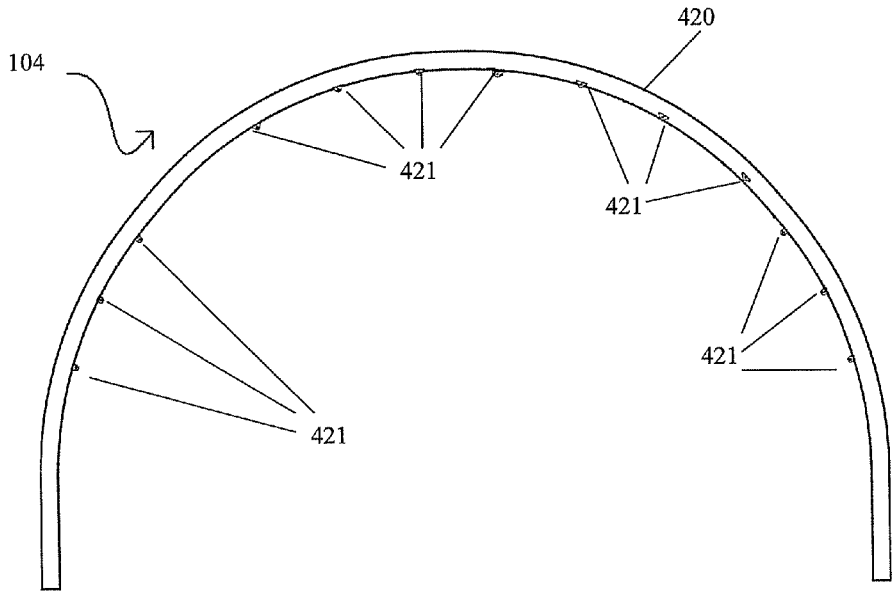
FIG. 8B is a side view of an arch assembly demonstrating an example distribution of arch tabs.

FIG. 8B is a side view of arch assembly 104 with a clearer depiction of one embodiment, not by limitation, of a distribution of the associated arch tabs. Arch assembly 104 includes multiple sets of arch tabs 421 running along the length of the assembly. Those skilled in the art will appreciate that any arch assembly can include any number of arch tabs, and in any configuration, without departing from the scope of the present invention.

Figure 9:
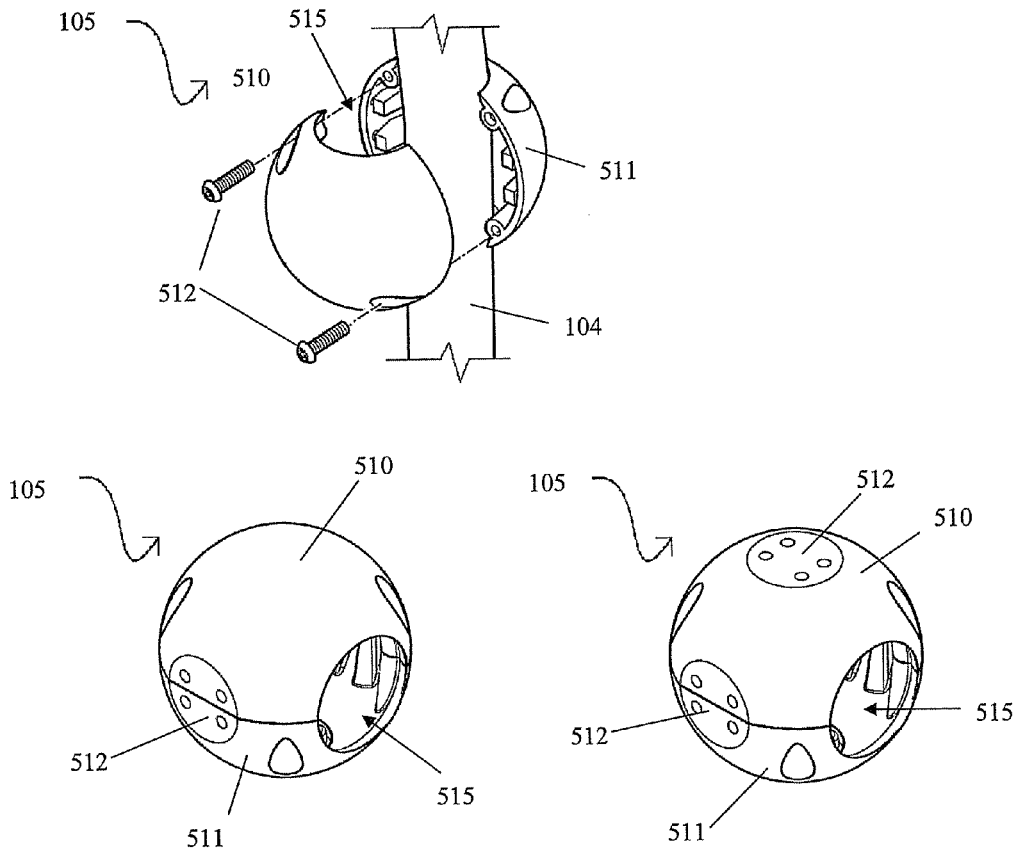
FIG. 9 is a perspective view of different embodiments of arch clamps.

FIG. 9 is a perspective view of several different embodiments of arch clamps 105. Arch clamps 105 can be configured to serve a variety of different purposes within system 100 (FIG. 1). For example, they can be utilized to cover (and secure) the seams between arch segments. Further, they can be utilized to add aesthetic value to the system based on their own appearance and/or by covering any portion of the system having a relatively unappealing visual quality.

Each arch clamp 105 illustratively includes two main portions, 510 and 511, that are configured to be connected to each other utilizing a connection mechanism such as, but not necessarily limited to, screws 512. Portions 510 and 511 together define an opening 515. As is illustrated, opening 515 is configured to receive an arch assembly (arch 104 is shown for illustrative purposes) when portions 510 and 511 are secured together. In one embodiment, in this manner, an arch clamp 105 can be firmly secured to an arch assembly. It should be noted that the scope of the present invention is not limited to securing clamps 105 to an arch assembly. Opening 515 can be otherwise configured to support attachment to an elongated member other than an arch assembly (e.g., attachment to a play element added to system 100, the play element requiring an opening 515 with a different circumference).

In one embodiment, as is illustrated, an arch clamp 105 can include one or more connection surfaces 512. In general, connection surfaces 512 are configured to support a connection between an arch clamp 105 and another element within system 100 (e.g., a play element added to the system). Those skilled in the art will appreciate that surface 512 can be configured to support any of a variety of different attachment schemes. In one embodiment, as will be described in more detail in relation to FIG. 10, connection surfaces 512 are configured to support connection to a ball clamp. In accordance with this embodiment, a surface 512, which is collectively formed by portions 510 and 511, includes a flat surface with openings to accommodate engagement to one or more attachment mechanisms (e.g., engagement to four screws) associated with a ball clamp. The nature of this engagement will become more apparent upon the description of FIG. 10 below.

In one embodiment, an arch clamp 105 includes two connection surfaces 512, wherein the plane comprising one surface and the plane comprising the other surface form an approximate right angle relative to one another. In another embodiment, connection surfaces 512 are on opposite sides of the arch clamp 105. Those skilled in the art will appreciate that a given arch clamp 105 can have one, two, three or more connection surfaces 512 depending upon the need for attachments within a given implementation.

Figure 10:
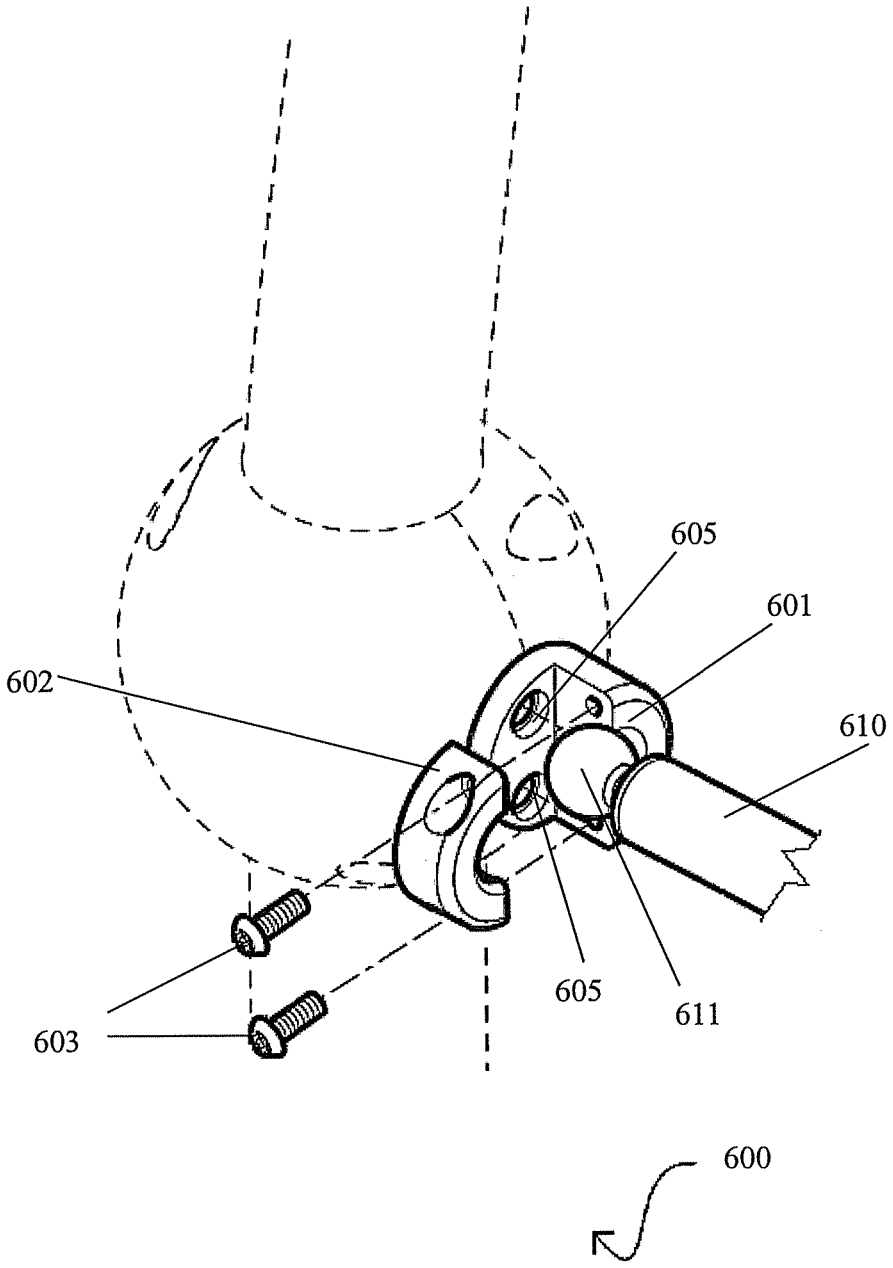
FIG. 10 is a schematic view of a schema for connecting an arch assembly to a play element.

FIG. 10 is a perspective view of an embodiment of a ball clamp 600. Ball clamps are used to connect elements such as (but not necessarily limited to) play elements to arch clamps. In this manner, elements are added to system 100. Examples of specific elements that can be added to system 100 will be described below in relation to other Figures.

A ball clamp 600 illustratively includes two main portions. In one embodiment, a first portion 601 is configured for mounting to a connection surface 512 of an arch clamp 105. Portion 601 is also configured to receive a ball 611 associated with an element 610. In one embodiment, not by limitation, portion 601 also includes one or more openings 605. In one embodiment, an attachment mechanism such as a screw (not shown) is inserted through an opening 605 and engaged to a corresponding opening in an attachment surface 512 so as to secure portion 601 to an arch clamp 105. Ball clamp 600 also includes a second portion 602 that is configured to receive the ball 611 and to firmly connect to portion 601 utilizing a connection mechanism such as, but not necessarily limited to, screws 603. Those skilled in art will appreciate that a ball clamp 600 enables a secure connection of element 610 to an arch clamp 105 (i.e., ball clamp 600 is secured to a surface 512 and securely contains a ball 611).

Figure 11:
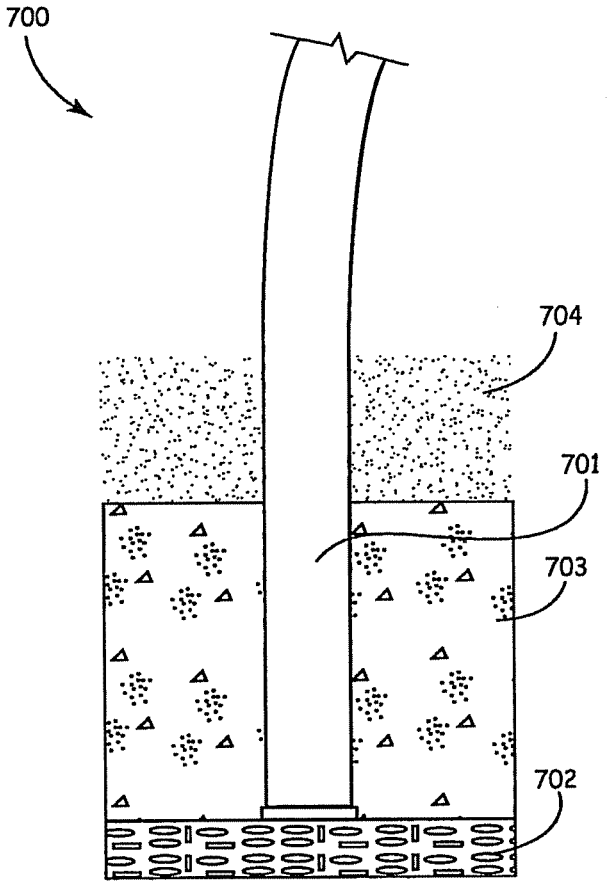
FIG. 11 is a side view of an arch assembly footing.

FIG. 11 is a side view of an arch assembly footing 700 illustratively utilized at each end of an arch assembly (e.g., assembly 101, 102, 103 or 104) in order to secure the structure in the ground. This is but one example of an appropriate footing to which the scope of the present invention is not limited. Footing 700 includes a foot portion 701. Portion 701 is positioned upon crushed rock 702 (e.g., at least four inches). In one embodiment, portion 702 is encased by a cylindrical concrete footing 703 (e.g., height of at least 30 inches and a minimum diameter of 24 inches). In one embodiment, a protective surface 704 is included in the form of loose-fill material or pour-in-place material.

Figure 12:
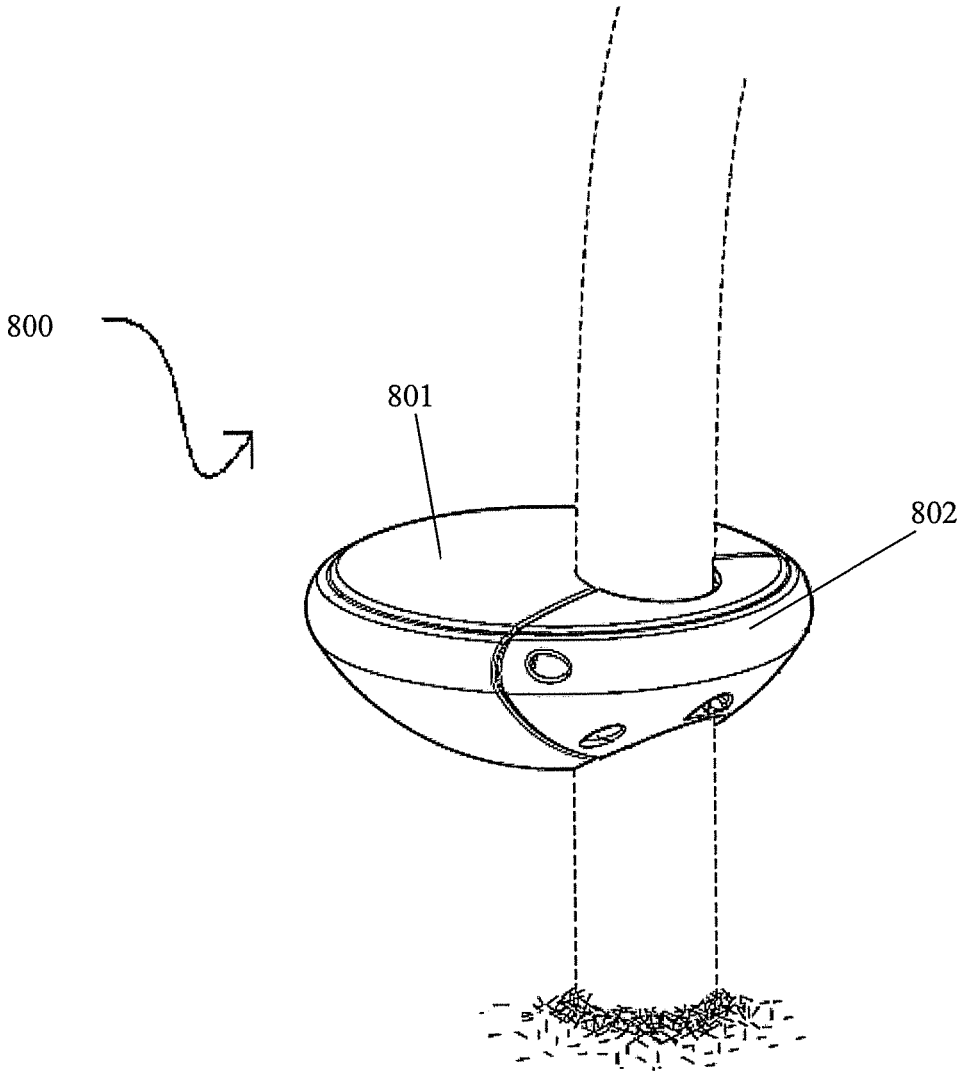
FIG. 12 is a perspective view of a stepping surface.

FIG. 12 is a perspective view of an embodiment of a stepping surface 800. A stepping surface enables a user of system 100 to move from one place to another, for example without touching the ground. Any number of stepping surfaces can be integrated into system 100 without departing from the scope of the present invention. Stepping surface 800 includes two portions. A portion 801 is configured to partially surround an arch assembly (e.g., assembly 101, 102, 103 or 104). A portion 802 is configured to partially surround a remaining portion of the arch assembly. A connection mechanism such as, but not limited to, screws or bolts are utilized to secure portions 801 and 802 to one another, thereby securing the stepping surface to the arch assembly. Stepping surfaces 800 can alternatively be attached to any other element within system 100 (e.g., attached to a play element). Those skilled in the art will appreciate that the opening formed between portions 801 and 802 can be sized to accommodate attachment to any of a variety of different elements.

Those skilled in the art will understand that many different types of play elements can be incorporated into system 100. The scope of the present invention is not limited to any one element or any combination of elements. However, for the purpose of providing a complete description, a broad range of specific examples of element implementations will be provided. The present invention is not limited to any one illustrated example, nor to any combination of illustrated examples.

Figure 13:
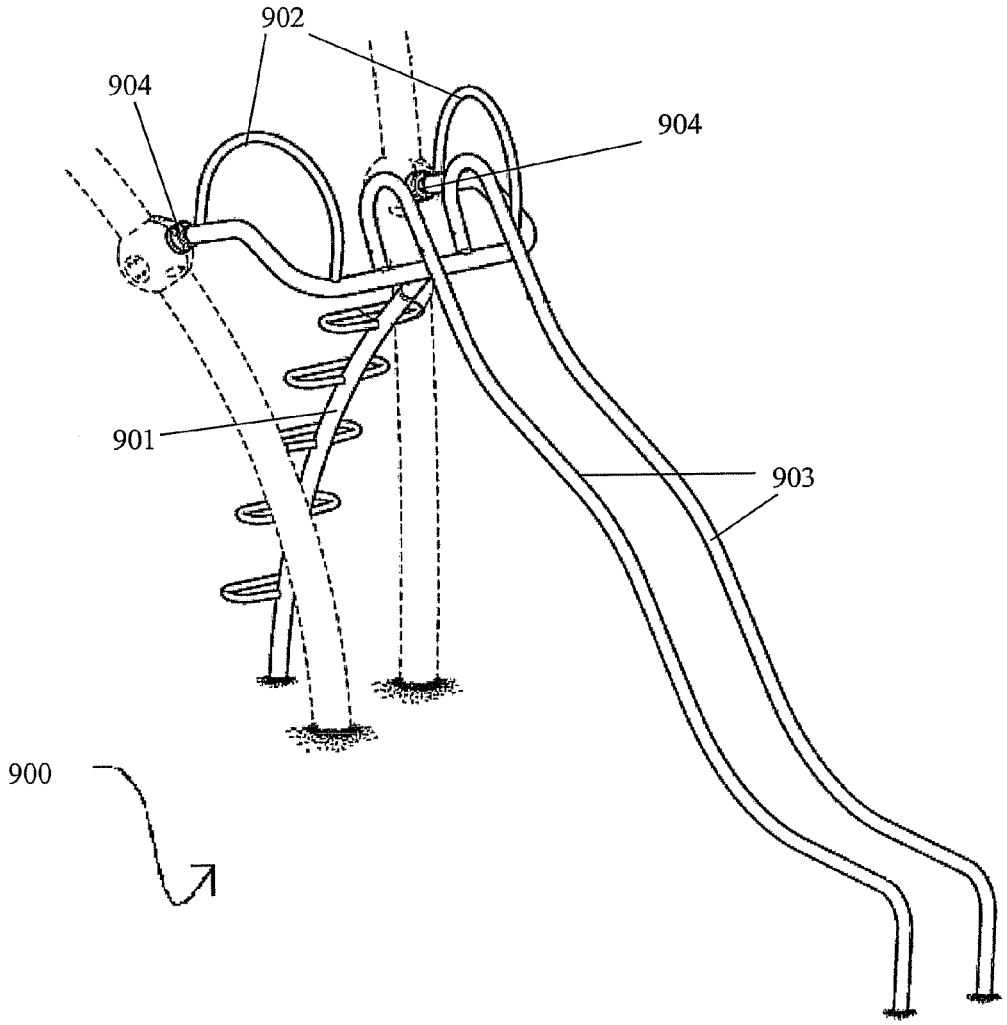
FIG. 13 is a perspective view of a ribbon slide.

FIG. 13 is a perspective view of a first example of a play element that can be incorporated into system 100. The play element in FIG. 13 is a ribbon slide 900. Ribbon slide 900 includes a curved stepping pole 901, two crossover bars 902, two rails 903, and two attachments 904. Attachments 904 are illustratively configured to connect to an arch assembly. In one embodiment, attachments 904 are consistent with the attachment scheme described above in relation to FIG. 10. In one embodiment, certainly not by limitation, the two ribbon slide rails 903 are substantially parallel and separated by a distance of approximately 12 inches. Stepping pole 901 and rails 903 are illustratively secured to the ground using footings, possibly similar to the footing scheme described above in relation to FIG. 11.

Ribbon slide 900 can be used in many different ways. For example, one could climb up stepping pole 901 and then work his/her way down to the ground using one or both of the ribbon slide rails 903 for support. In another example, one could use crossover bars 902 as an aid to move onto the slide rails and/or from one arch assembly to another. These are simply two of many play options that will be apparent to those skilled in the art.

Figure 14:
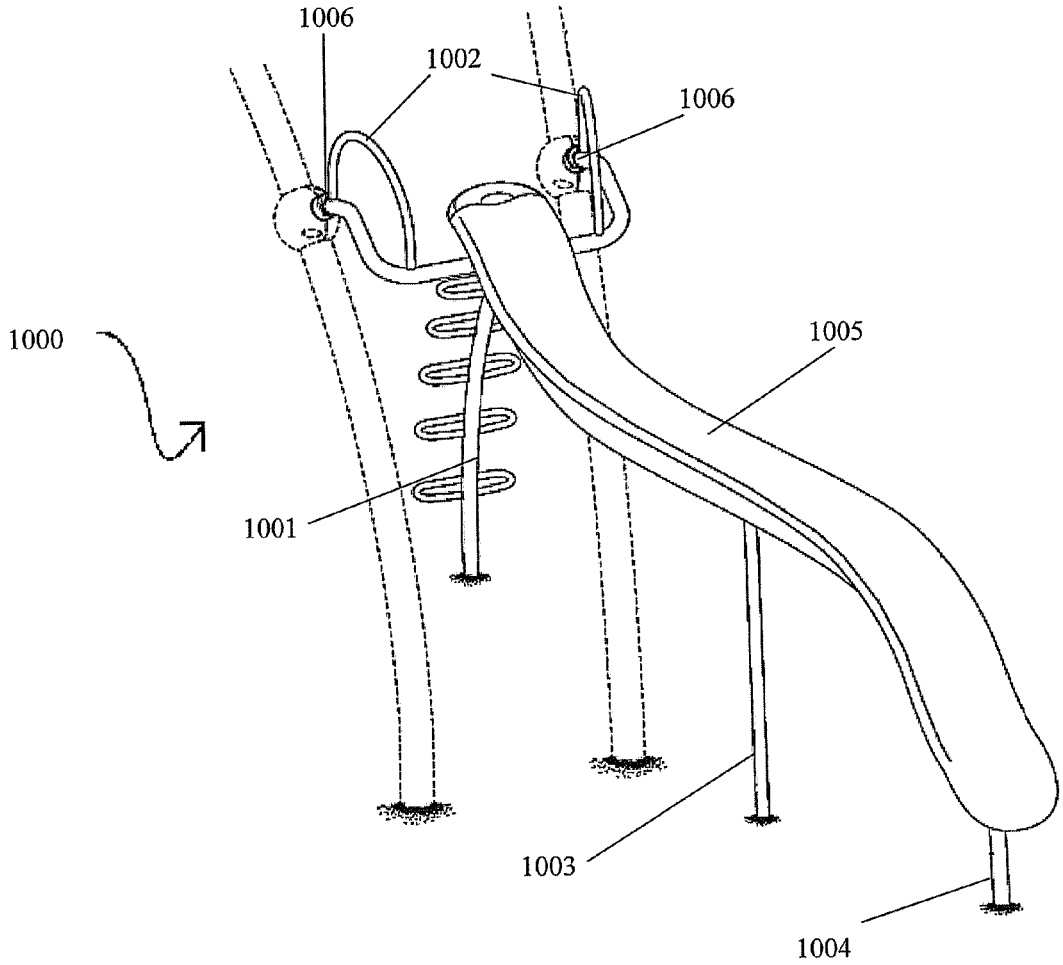
FIG. 14 is a perspective view of a winding slide.

FIG. 14 is a perspective view of another example of a play element that can be incorporated into system 100. The play element in FIG. 14 is a winding slide 1000. Winding slide 1000 includes a stepping pole 1001, two crossover bars 1002, a mid-support 1003, an exit support 1004, a winding slide panel 1005, and two attachments 1006. Attachments 1006 are illustratively configured to connect to an arch assembly. In one embodiment, attachments 1006 are consistent with the attachment scheme described above in relation to FIG. 10. Stepping pole 1001, mid-support 1003, and exit support 1004 are illustratively secured to the ground using footings, such as footings similar to those described above in relation to FIG. 11.

Winding slide 1000 can be used in many different ways. For example, one could climb up stepping pole 1001 and then work his/her way down to the ground using winding slide panel 1005. In another example, one could use crossover bars 1002 as an aid to move onto panel 1005 and/or from one arch assembly to another. These are simply two of many play options that will be apparent to those skilled in the art.

Figure 15:
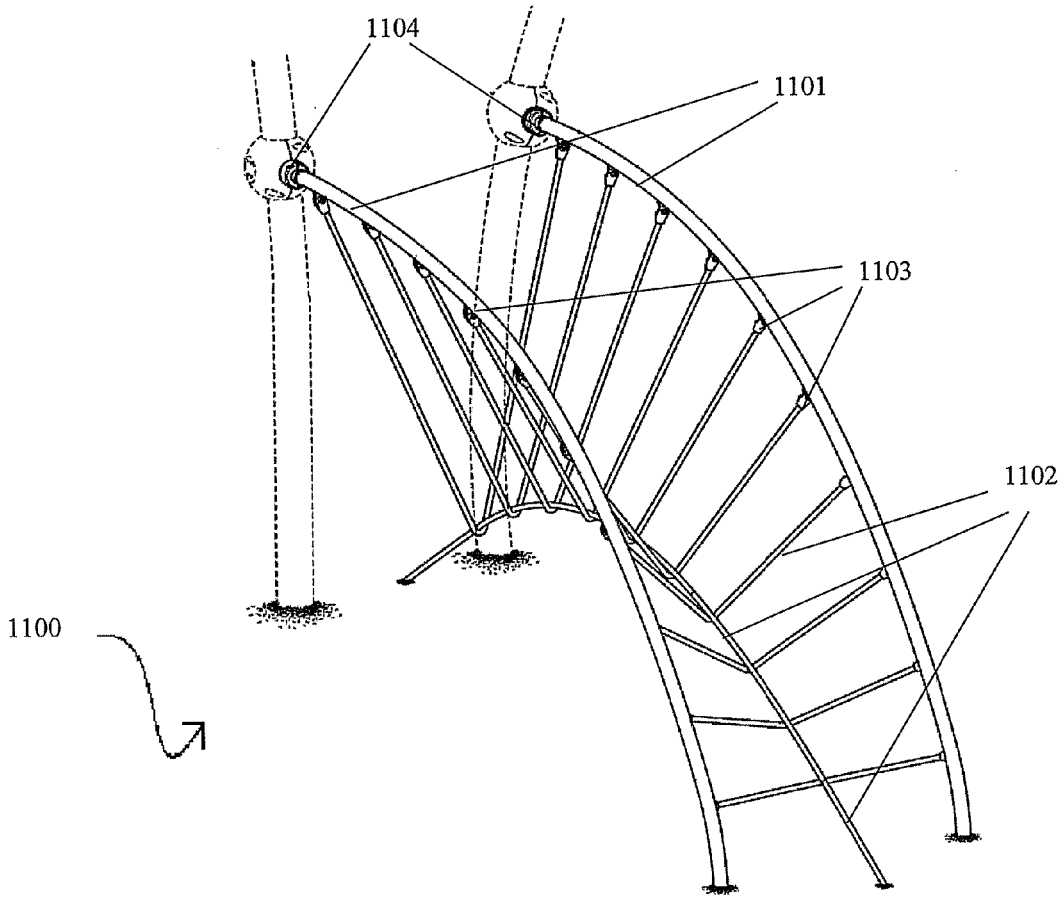
FIG. 15 is a perspective view of a cable rope climber.

FIG. 15 is a perspective view of another example of a play element that can be incorporated into system 100. The play element in FIG. 15 is a cable rope climber 1100. Cable rope climber 1100 includes two auxiliary arches 1101, a cable rope net assembly 1102, and auxiliary arch tabs 1103. Also included are attachments 1104, which are illustratively configured to connect to an arch assembly. In one embodiment, attachments 1006 are consistent with the attachment scheme described above in relation to FIG. 10. In one embodiment, auxiliary arches are secured to the ground using footings, such as footings similar to the concrete footing shown in FIG. 11.

Figure 16:
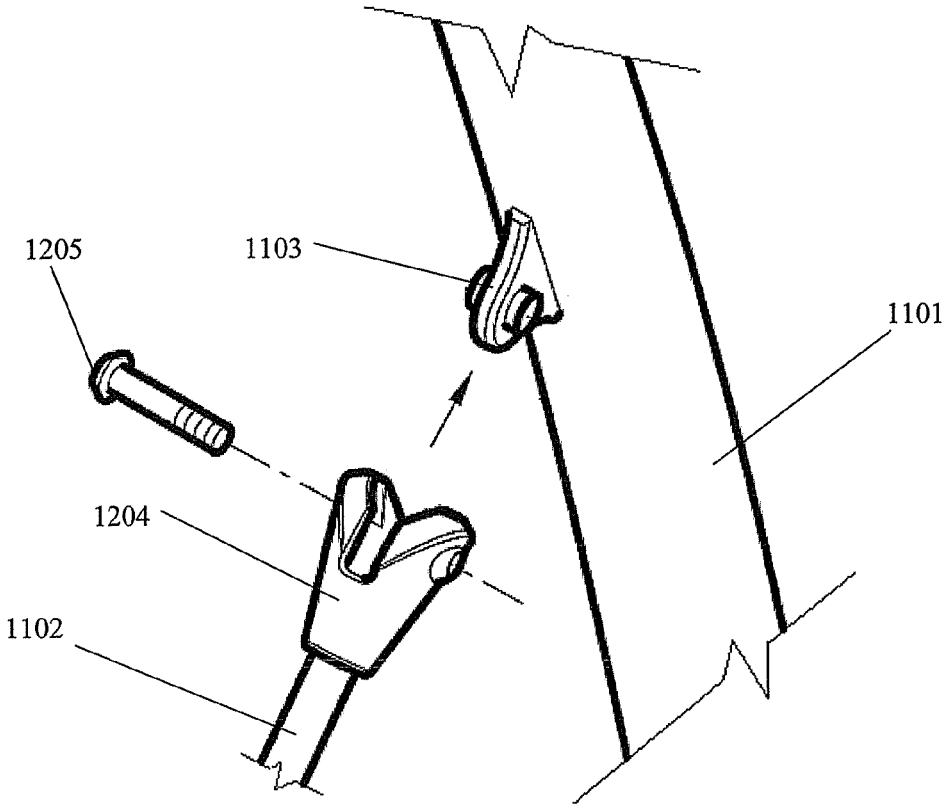
FIG. 16 is a schematic representation of a scheme for attaching an elongated portion of a cable rope climber to an associated net assembly.

FIG. 16 is a diagrammatic representation of one embodiment, not by limitation, of a connection between an auxiliary arch tab 1103 and a portion of net assembly 1102. As is shown, the connection scheme involves an engagement between an auxiliary arch tab 1103 and a cable rope climber net assembly end connector 1204, which is secured by a connection mechanism such as but not limited to the illustrated screw 1205. In one embodiment, end connector 1204 is illustratively configured to attach to arch tab 1202 in such a way that the end connector is allowed to rotate around the axis of the screw.

Figure 17:
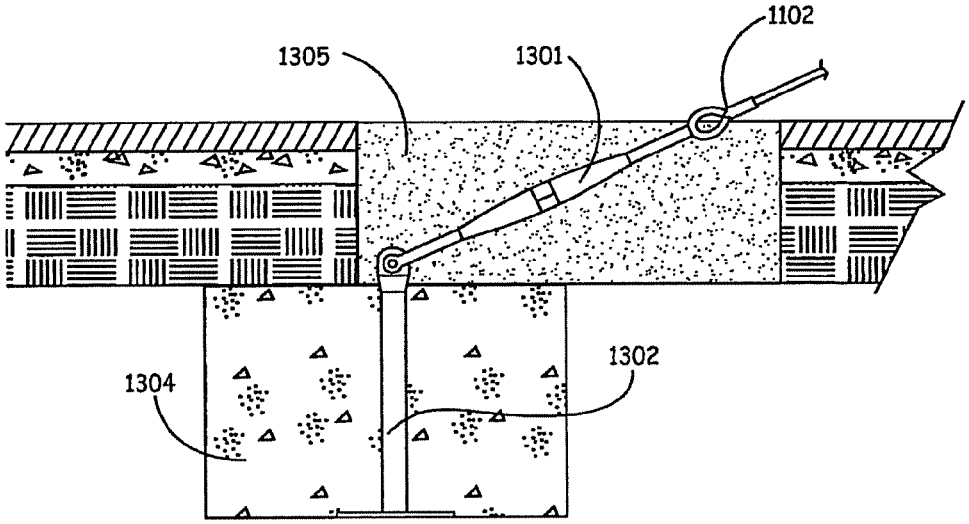
FIG. 17 is a schematic representation of a cable rope climber turnbuckle assembly.

FIG. 17 is a side view of one embodiment of a turnbuckle assembly for cable rope climber 1100. Two turnbuckle assemblies are illustratively used to secure cable rope climber net 1102 to the ground. Each assembly illustratively includes a turnbuckle 1301 and a footer portion 1302. Turnbuckle 1301 is illustratively configured to connect the footer 1302 to net 1102. Footer 1302 is secured by a footing 1304 (e.g., a concrete footing). In one embodiment, the turnbuckle and footer are covered with loose fill material 1305.

Cable rope climber 1100 can be used in many different ways. For example, one could climb upon cable rope net 1102 and work from one end to the other. This is but one of many play options that will be apparent to those skilled in the art.

Figure 18:
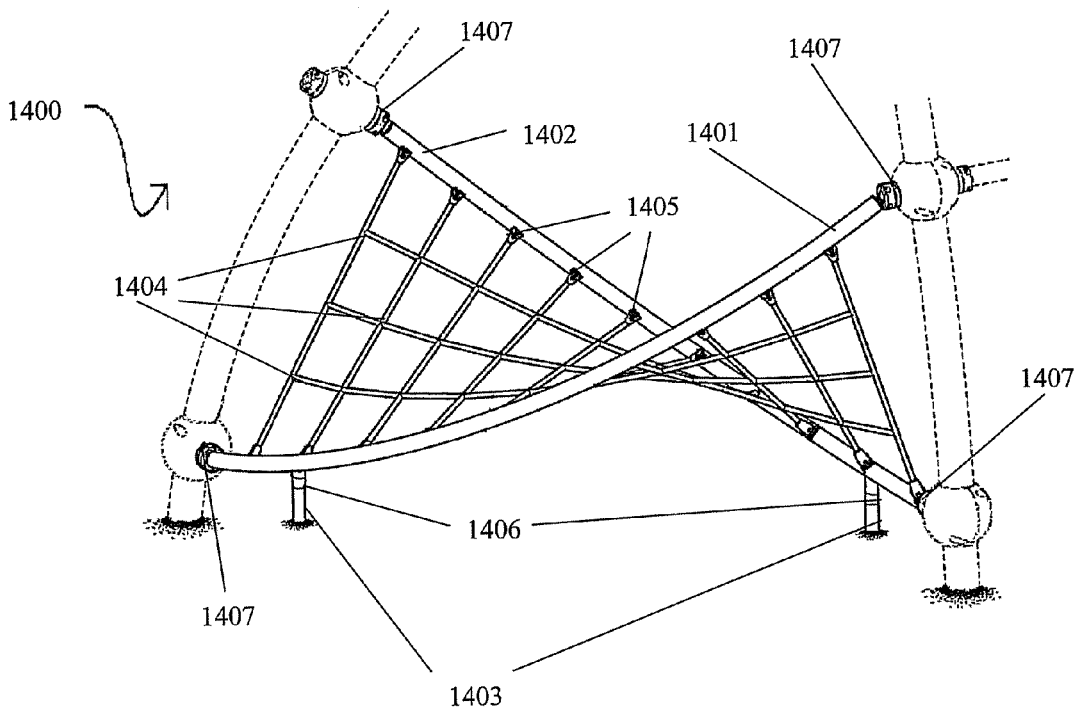
FIG. 18 is a perspective view of a twisted net.

FIG. 18 is a perspective view of another embodiment of a play element that can be incorporated into system 100. The play element in FIG. 18 is a twisted net 1400. Element 1400 includes a first twisted net railing 1401, a second twisted net railing 1402, footers 1403, attachments 1407, and a net assembly 1404. Attachments 1407 are illustratively configured to connect to an arch assembly. In one embodiment, attachments 1407 are consistent with the attachment scheme described above in relation to FIG. 10. In one embodiment, certainly not by limitation, railing 1401 is approximately 92.5 inches long and railing 1402 is approximately 47.75 inches long. In one embodiment, railings 1401 and 1402 include tabs 1405 that run along the length of the railings and are used to attach net assembly 1404 to the railings. In one embodiment, tabs 1405 and net assembly 1404 incorporate an attachment scheme the same or similar to the scheme described above in relation to FIG. 16. In one embodiment, each of railings 1401 and 1402 includes a sleeve member 1406 that connects to a footer 1403 to provide additional support. In one embodiment, footers 1403 are similar to the concrete footing described above in relation to FIG. 11.

Twisted net 1400 can be used in many different ways. For example, one could support his/herself using any or all of railing 1401, railing 1402 and net assembly 1404. One could work from one end of net 1404 to the other. This is but one of many examples of play options that will be apparent to those skilled in the art.

Figure 19:
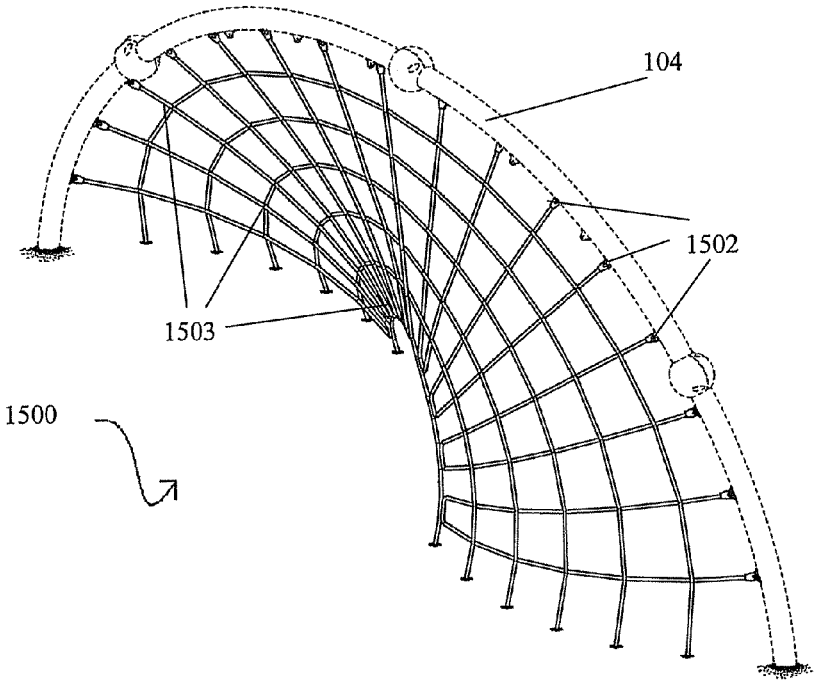
FIG. 19 is a perspective view of a climbing net.
Figure 20:
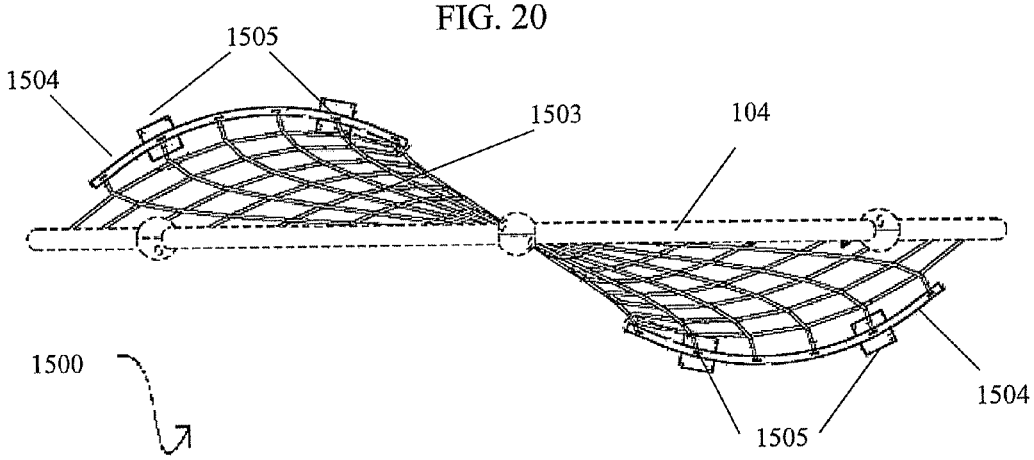
FIG. 20 is a top view of the climbing net.

FIG. 19 is a perspective view of another example of a play element that can be incorporated into system 100. The play element in FIG. 19 is a climbing net 1500. A top view of climbing net 1500 is shown in FIG. 20. Climbing net 1500 is illustratively integrated into an arch assembly which, for illustrative purposes only, is identified in FIGS. 19 and 20 as arch assembly 104. Climbing net 1500 includes arch tabs 1502, a net assembly 1503, footers 1504 and footings 1505. The net assembly 1503 is attached to both arch tabs 1502 and to footers 1504. In one embodiment, the attachment scheme utilized to connect net assembly 1503 to the arch assembly 104 is the same or similar to the attachment scheme described above in relation to FIG. 16. Each footer 1504 is illustratively secured to the ground by footings 1505. In one embodiment, footings 1505 are the same or similar to the footing described above (e.g., in relation to FIG. 11 or FIG. 17). Net assembly 1503 is illustratively placed in some degree of tension such that the net is relatively tight and stable.

Climbing net 1500 can be used in many different ways. For example, one could go from the ground to the top of an arch assembly, or one could use the element to transfer from one play element to another. These are just two of many play options that will be apparent to those skilled in the art.

Figure 21:
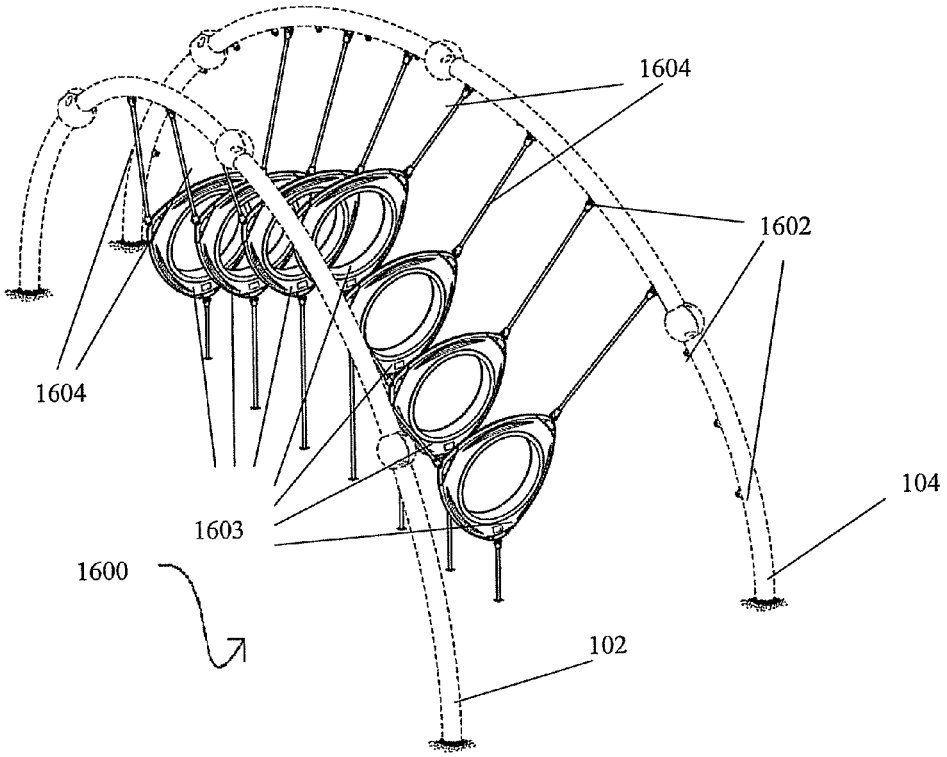
FIG. 21 is a perspective view of the climbing rings assembly.
Figure 22:
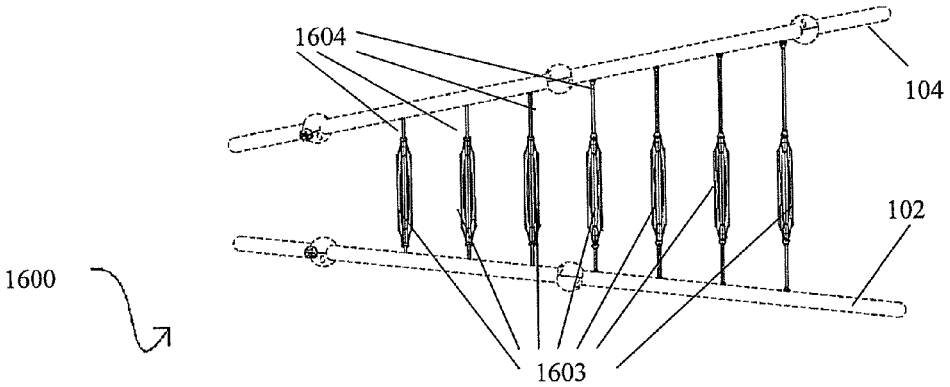
FIG. 22 is a top view of a climbing rings assembly.

FIG. 21 is a perspective view of another example of a play element that can be incorporated into system 100. The play element in FIG. 21 is a climbing rings assembly 1600. A top view of the element is shown in FIG. 22. Climbing ring assembly 1600 is illustratively implemented in relation to two arch assemblies, which, or illustratively purposes only, are identified in FIG. 21 as arch assemblies 102 and 104. Climbing rings assembly 1600 includes arch assembly tabs 1602, rings 1603 and cables 1604. For each ring, one cable attaches to arch assembly 104, another cable attaches to arch assembly 102, and another cable attaches to a footing. In one embodiment, the attachment scheme utilized to connect a ring 1603 via its associated cables is the same or similar to the attachment scheme described above in relation to FIG. 16. In one embodiment, the footing beneath each ring is similar to the footing scheme described above (e.g., in relation to FIG. 11 or FIG. 17). In one embodiment, the lengths of the cables utilized to suspend the rings are chosen such that the rings are aligned in an arch configuration, as is best illustrated in FIG. 21. Each ring 1603 is illustratively placed in some degree of tension such that it is relatively tight and stable.

Climbing rings assembly 1600 can be used in many different ways. For example, one could go through rings 1603 from one end to the other. Or, one could use the rings assembly to transfer from one play element to another. These are just two of many play options that will be apparent to those skilled in the art.

Figure 23:
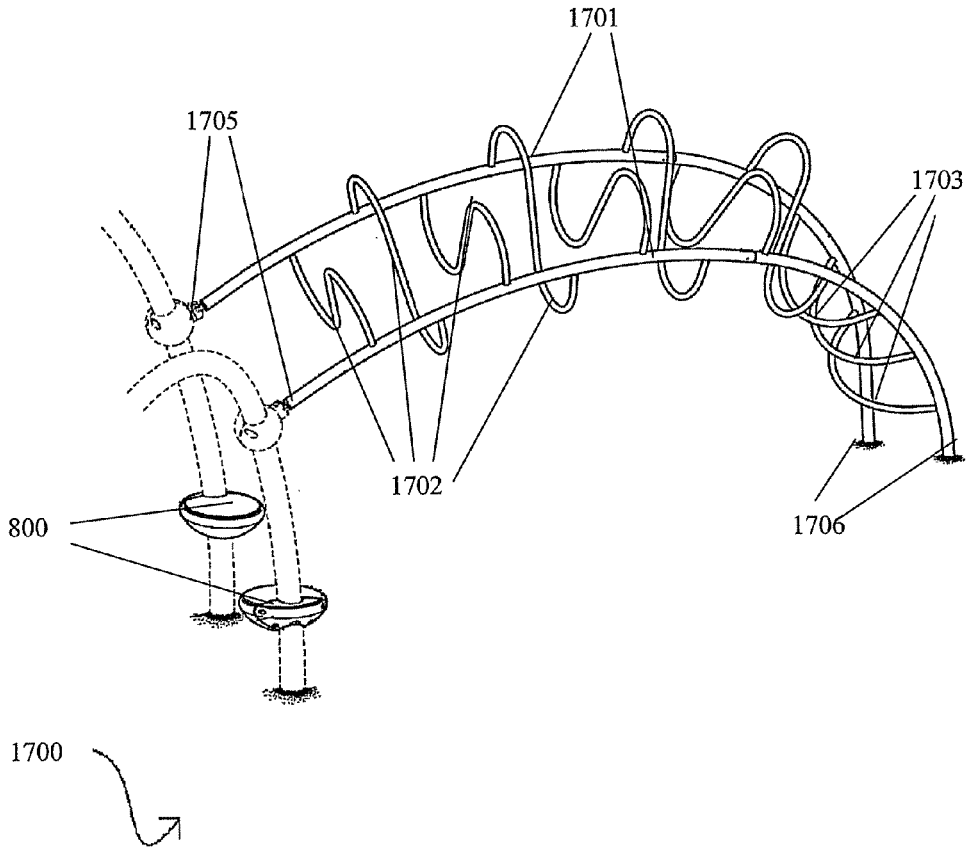
FIG. 23 is a perspective view of a pipe climber.

FIG. 23 is a perspective view of another example of a play element that can be incorporated into system 100. The play element in FIG. 23 is a pipe climber 1700. Pipe climber 1700 includes two arches 1701 connected by alternating sinusoidal-like crossbars 1702 and by arch-shaped crossbars 1703. In one embodiment, stepping surfaces 800, such as surfaces the same or similar to those described above in relation to FIG. 12, are included to increase accessibility of the play element. Attachments 1705 are included on the top ends of arches 1701. Attachments 1705 are illustratively configured to connect to an arch assembly. In one embodiment, attachments 1705 are consistent with the attachment scheme described above in relation to FIG. 10. The opposite ends of arches 1701 are configured to attach to a footing, such as a footing the same or similar that described above in relation to FIG. 11.

Pipe climber 1700 can be used in many different ways. For example, one could use the crossbars to move from the ground to an elevated position in which access to another play element is possible. This is but one of the many play options that will be apparent to those skilled in the art.

Figure 24:
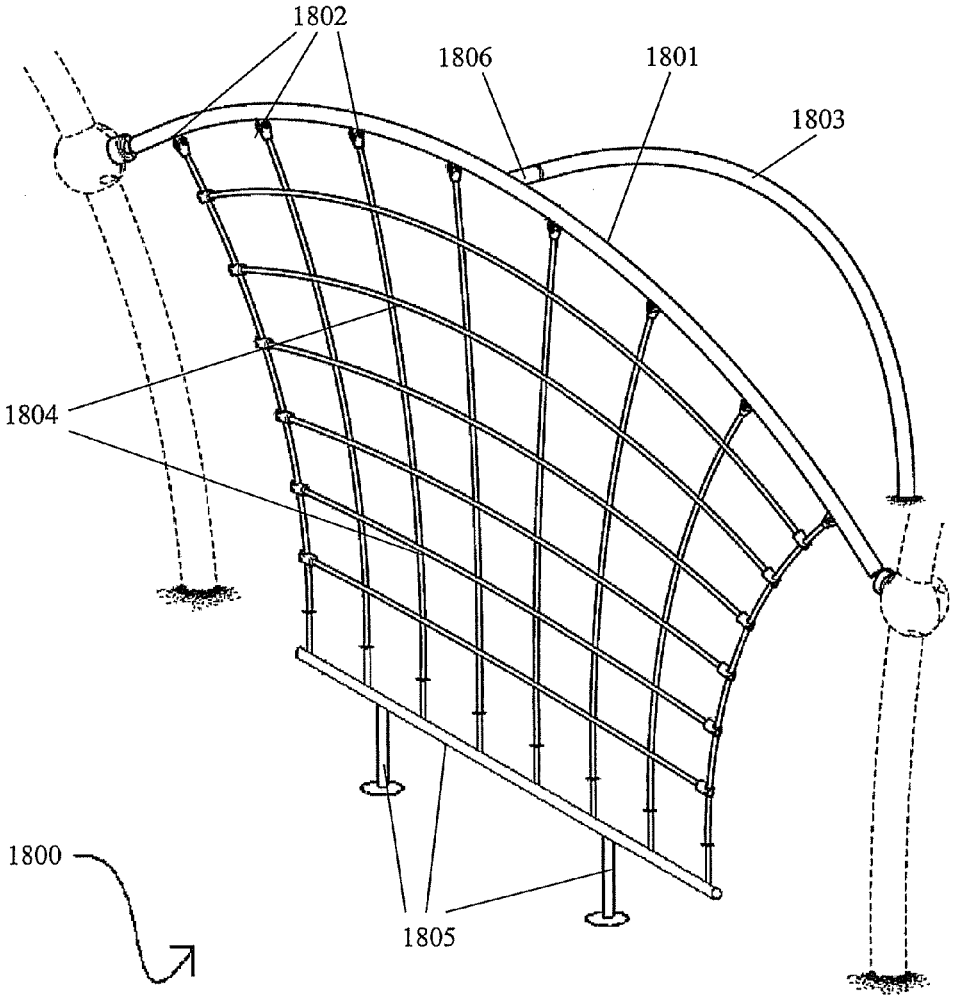
FIG. 24 is a perspective view of a rope climbing structure.

FIG. 24 is a perspective view of another example of a play element that can be incorporated into system 100. The play element in FIG. 24 is rope climbing structure 1800. Structure 1800 includes a climb across auxiliary arch 1801, auxiliary arch tabs 1802, a climb across auxiliary arch support 1803, a net assembly 1804, and a footer assembly 1805. The auxiliary arch 1801 includes attachments at each end configured to connect to an arch assembly. In one embodiment, the attachments are consistent with the attachment scheme described above in relation to FIG. 10. In one embodiment, arch 1801 also includes a sleeve 1806 configured to support a connection to one end of arch support 1803. The other end of arch support 1803 is illustratively secured to the ground using a footing, possibly similar to the footing scheme described above in relation to FIG. 11. Arch tabs 1802 run along the length of auxiliary arch 1801 and are configured to support net assembly 1804. In one embodiment, the connection between auxiliary arch 1801 and net assembly 1804 is accomplished utilizing a tab-oriented connection scheme such as a scheme that is the same or similar to that described above in relation to FIG. 16. The bottoms of net assembly 1804 can be connected to footers (e.g., so as to apply a tension to the netting) in any of a variety of different ways that will be apparent to those skilled in the art. Footer assembly 1805 is shown in dots to indicate that it is but one of many alternatives. Footer assembly 1805 eliminates the need for more than two in-ground footings.

Rope climbing structure 1800 can be used in many different ways. One could use the net structure to support oneself off from the ground and transfer between play elements without touching the ground. One could also climb the net from the ground, cross over the top of the net, and reach the opposite side. These are simply two of many play options that will be apparent to those skilled in the art.

Figure 25:
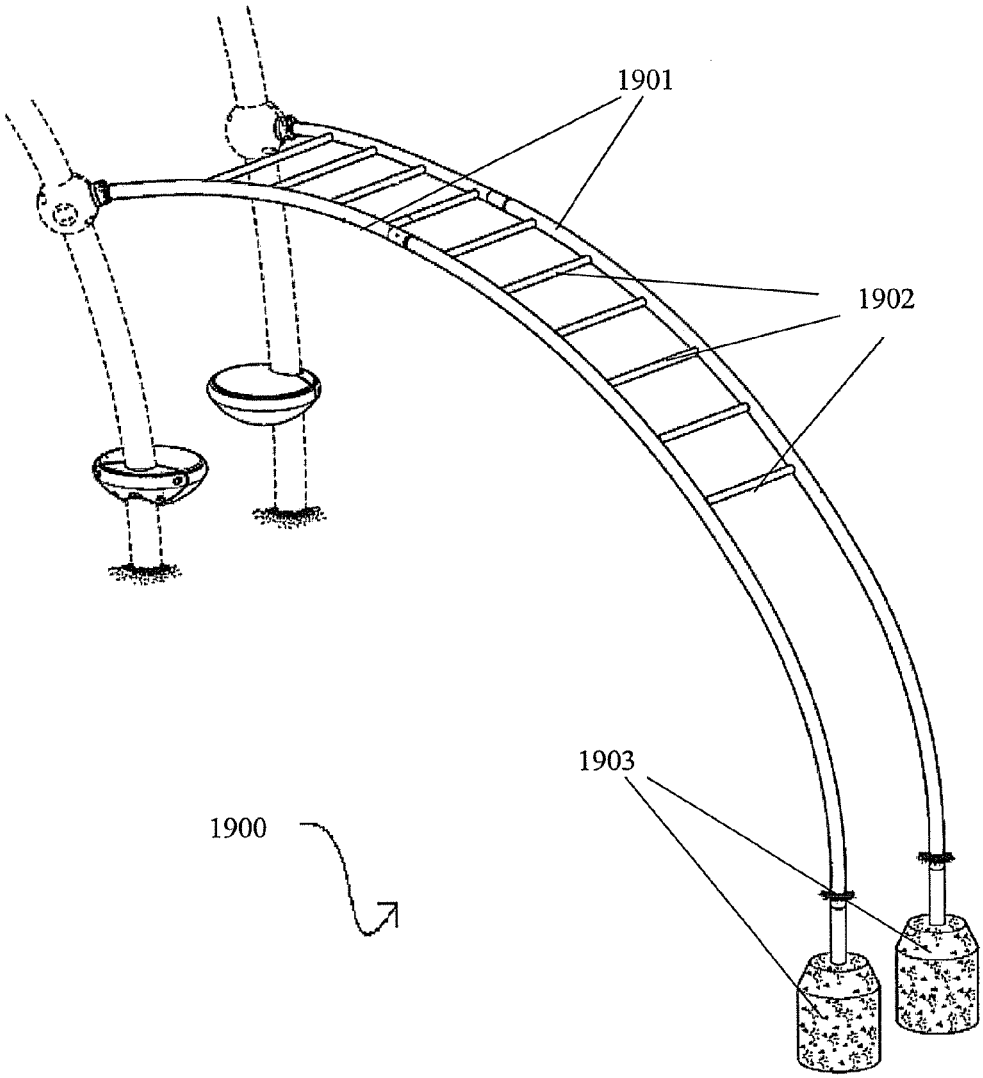
FIG. 25 is a perspective view of an arched bar structure.

FIG. 25 is a perspective view of another example of a play element that can be incorporated into system 100. The play element in FIG. 25 is an arched bar structure 1900. Structure 1900 includes two auxiliary arches 1901 (illustratively but not necessarily the arches are parallel relative to one another), hanging bars 1902 (illustratively but not necessarily perpendicular to and connecting auxiliary arches 1901), and footers 1903. One end of each auxiliary arch 1901 includes an attachment for connection to an arch assembly. In one embodiment, the attachments are consistent with the attachment scheme described in relation to FIG. 10. The other end of each auxiliary arch is configured to attach to a footer 1903, possibly similar to the footing scheme described above in relation to FIG. 11.

Arched bar structure 1900 can be used in many different ways. For example, one could support him or herself on top of the auxiliary arches and slide from the top of the structure to the bottom. One could also use the hanging bars to pull oneself from the ground to an elevated position and transfer to another play element. These are simply two of many play options that will be apparent to those skilled in the art.

Figure 26:
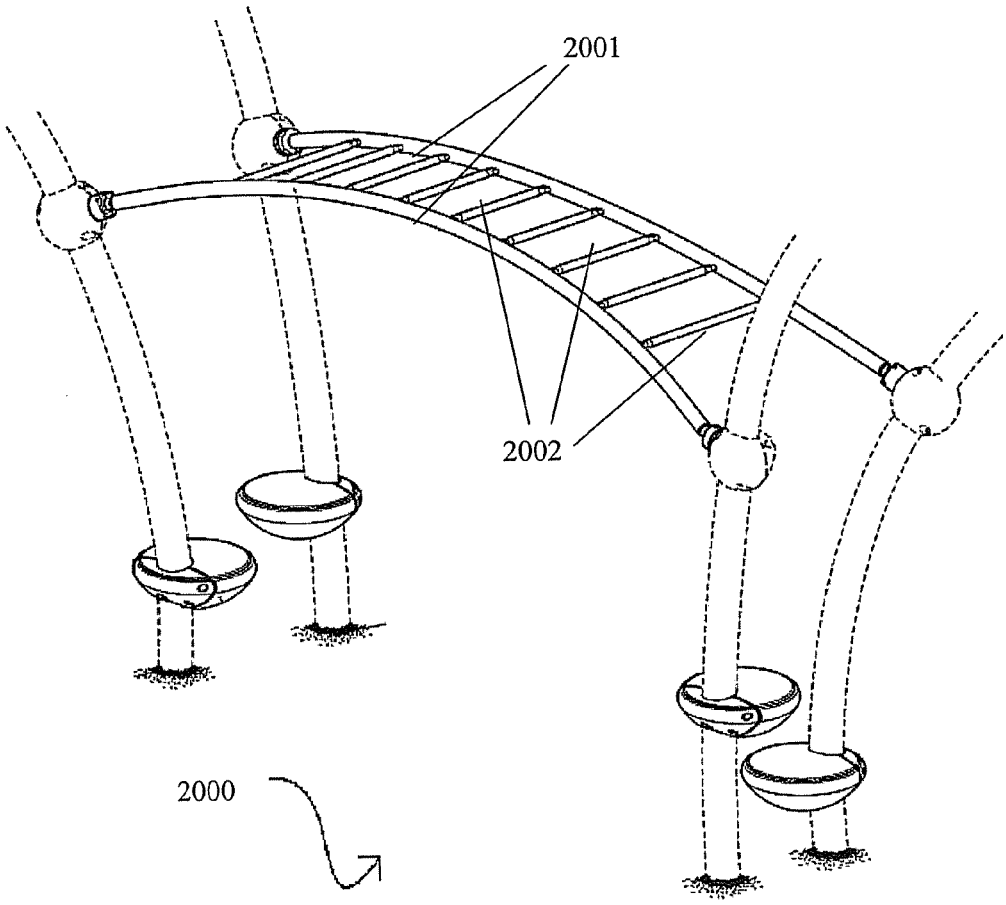
FIG. 26 is a perspective view of a hanging bars ladder.

FIG. 26 is a perspective view of another embodiment of a play element that can be incorporated into system 100. The play element in FIG. 26 is a hanging bars ladder 2000. Hanging bars ladder 2000 includes two auxiliary arches 2001 connected to each other by bars 2002. An attachment is located on each end of the auxiliary arches and enables a connection to an arch assembly. In one embodiment, the attachments are consistent with the attachment scheme described above in relation to FIG. 10.

Hanging bar ladder 2000 can be used in many different ways. For example, one can support themselves off from the ground by holding onto the bars and can then cross the distance of the ladder without touching the ground. This is but one of many play options that will be apparent to those skilled in the art.

Figure 27:
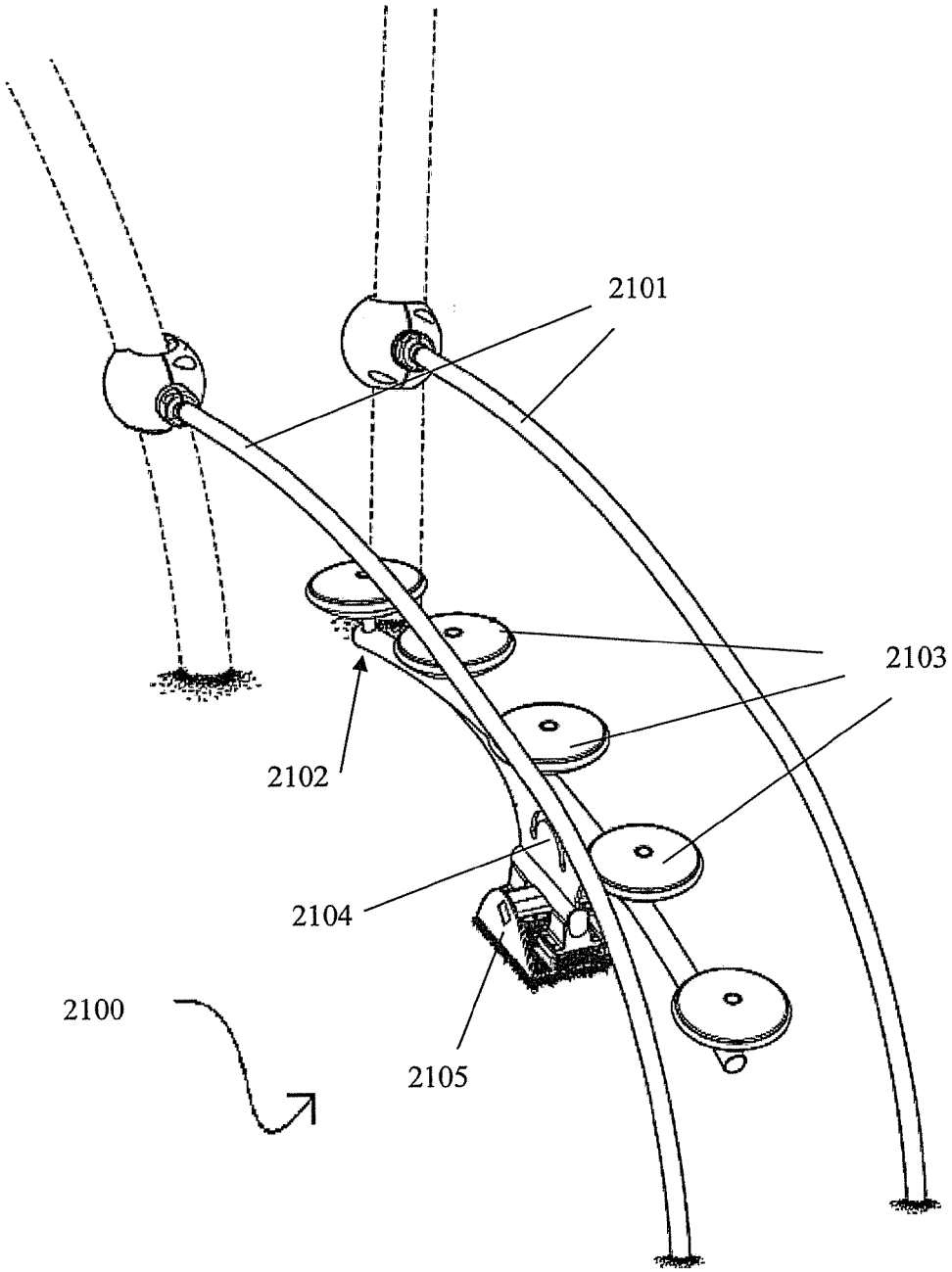
FIG. 27 is a perspective view of a pivoting walk-across.

FIG. 27 is a perspective view of another embodiment of a play element that can be incorporated into system 100. The element in FIG. 26 is a pivoting walk-across 2100. Pivoting walk-across 2100 includes two handrails 2101 and a pivoting assembly 2102. An attachment is located on one end of each handrail and enables a connection to an arch assembly. In one embodiment, the attachments are consistent with the attachment scheme described above in relation to FIG. 10. Pivoting assembly 2102 includes platform structures 2103, a pivoting assembly base 2104, and a seesaw leg 2105. Platform structures 2103 provide a surface to accommodate standing or sitting and are supported by pivoting assembly base 2102. The pivoting assembly base 2102 connects to seesaw leg 2105 in such a way as to enable the platform structures to move in an up-and-down in a seesaw-like fashion. The seesaw leg is illustratively mounted to the ground, for example, by way of concrete footing.

Pivoting walk-across 2100 can be used in many different ways. For example, children can teeter up-and-down while supporting their feet on the platform structures and supporting their hands on the handrails. This is but one of many play options that will be apparent to those skilled in the art.

Figure 28:
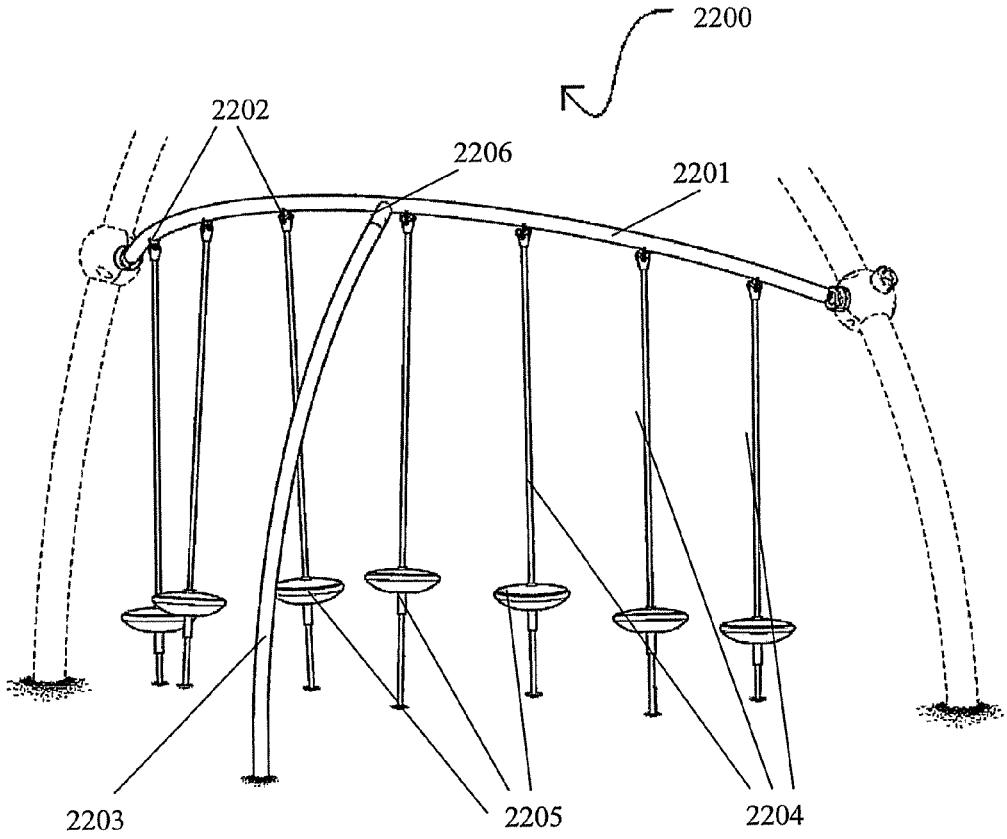
FIG. 28 is a perspective view of a cable-disk climber.

FIG. 28 is a perspective view of another example of a play element that can be incorporated into system 100. The play element in FIG. 28 is a cable-disk climber 2200. Cable-disk climber 2200 includes an auxiliary arch 2201, auxiliary arch tabs 2202, a support bar 2203, platform cables 2204, and platform assemblies 2205. The ends of auxiliary arch 2201 are configured to connect to an arch assembly. In one embodiment, this connection is made in a manner that is the same or similar to the connection scheme described above in relation to FIG. 10. Auxiliary arch 2201 includes a sleeve 2206 that is configured to facilitate to support bar 2203. The auxiliary arch tabs 2202 run along the length of auxiliary arch 2201 and are configured to connect to and support platform cables 2204. The platform cables 2204 are configured such that one end of each cable connects to and hangs from an arch tab 2202 and the other end connects to a footer in the ground. In one embodiment, the connection between a cable 2204 and arch 2201 is accomplished in a manner that is the same or similar to the connection scheme described in relation to FIG. 16.

Figure 29:
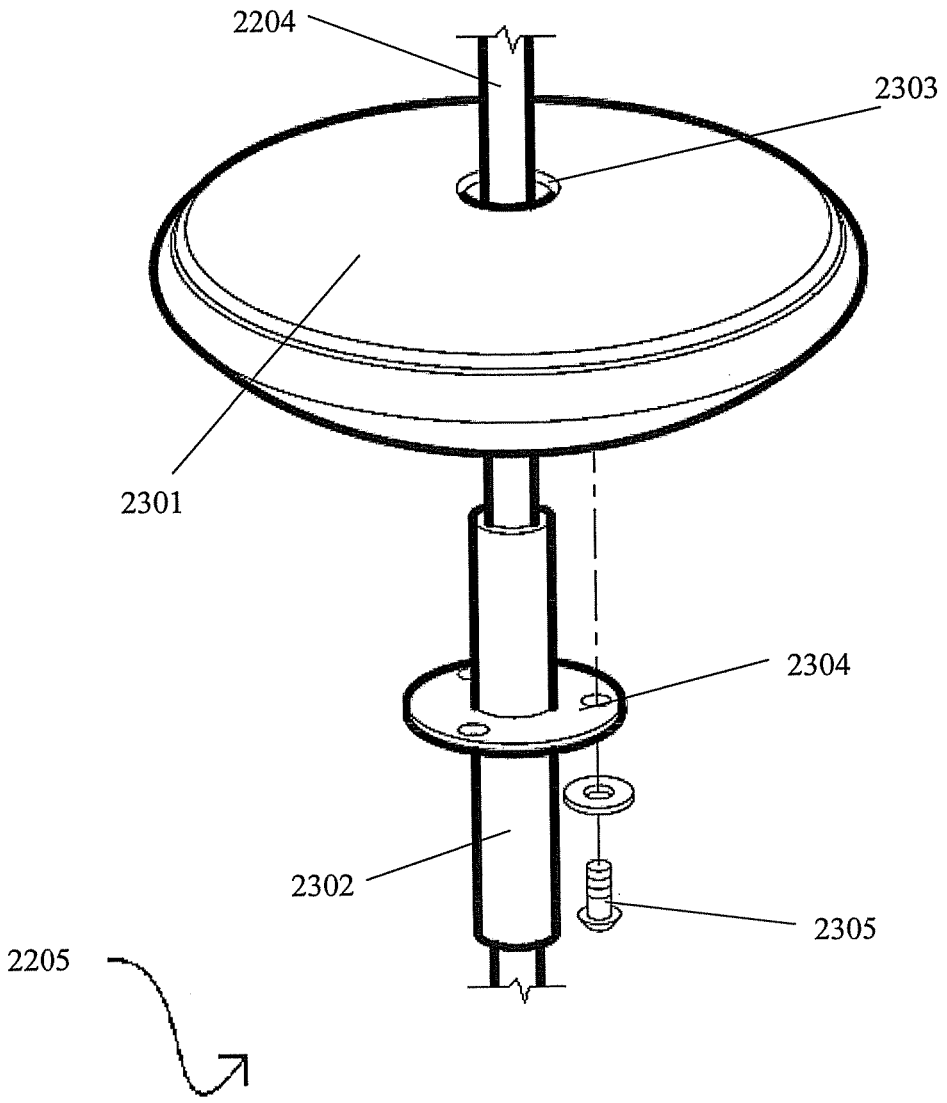
FIG. 29 is a perspective view of a cable-disk climber platform assembly.

FIG. 29 is a perspective view of an embodiment of a cable-disk climber platform assembly 2205. Assembly 2205 includes a platform 2301 and a cable bracket 2302. Platform 2301 includes a platform aperture 2303 that allows platform cable 2204 to pass through the platform. Cable bracket 2304 is attached to cable 2204 and has a surface 2304 configured to support platform 2301. The platform and bracket are secured together utilizing a connection mechanism such as, but not necessarily limited to, screws 2305.

Cable-disk climber 2200 can be used in many different ways. For example, children can support themselves using the platform cables only and swing from one cable to another. Children could also use both the cables and platform assemblies to support themselves and cross from one end of the structure to the other. These are simply two of many play options that will be apparent to those skilled in the art.

Figure 30:
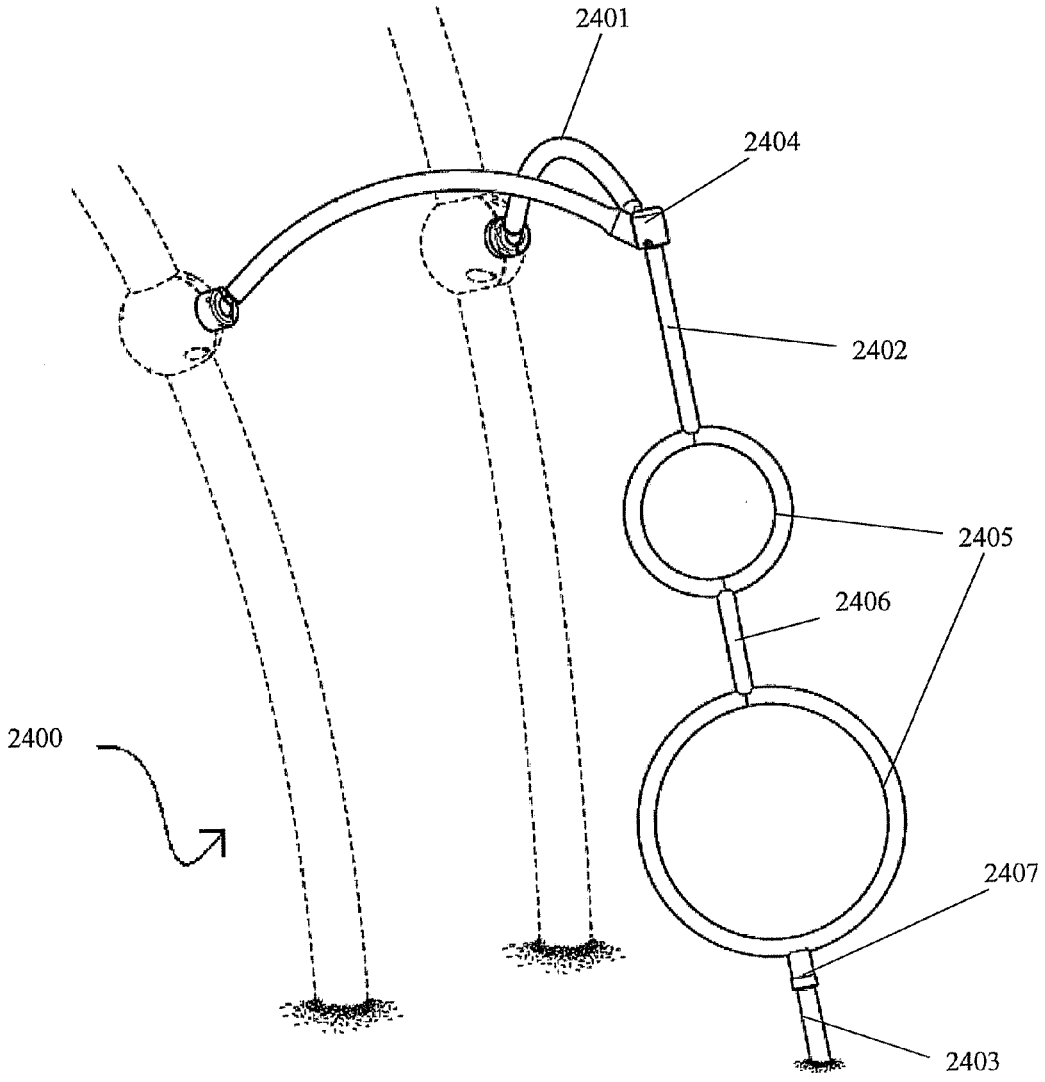
FIG. 30 is a perspective view of a ringed spinner.

FIG. 30 is a perspective view of another example of a play element that can be incorporated into system 100. The play element in FIG. 30 is a ringed spinner 2400. Ringed spinner 2400 includes an upper spinner mount 2401, a ring assembly 2402, and a footer 2403. The upper spinner mount includes two bars joined together in a "V" shaped fashion. The two top ends of the "V" each include an attachment for connection to an arch assembly. In one embodiment, the attachments are consistent with the attachment scheme described in relation to FIG. 10. The bottom end of the "V", portion 2404, is configured to support the ring assembly in such a way as to allow the ring assembly to rotate. The ring assembly includes two ring shaped structures 2405 attached by a middle bar 2406. The ring assembly bottom end 2407 and footer 2403 are configured to be secured together in such a way that the ring assembly can rotate.

Figure 31:
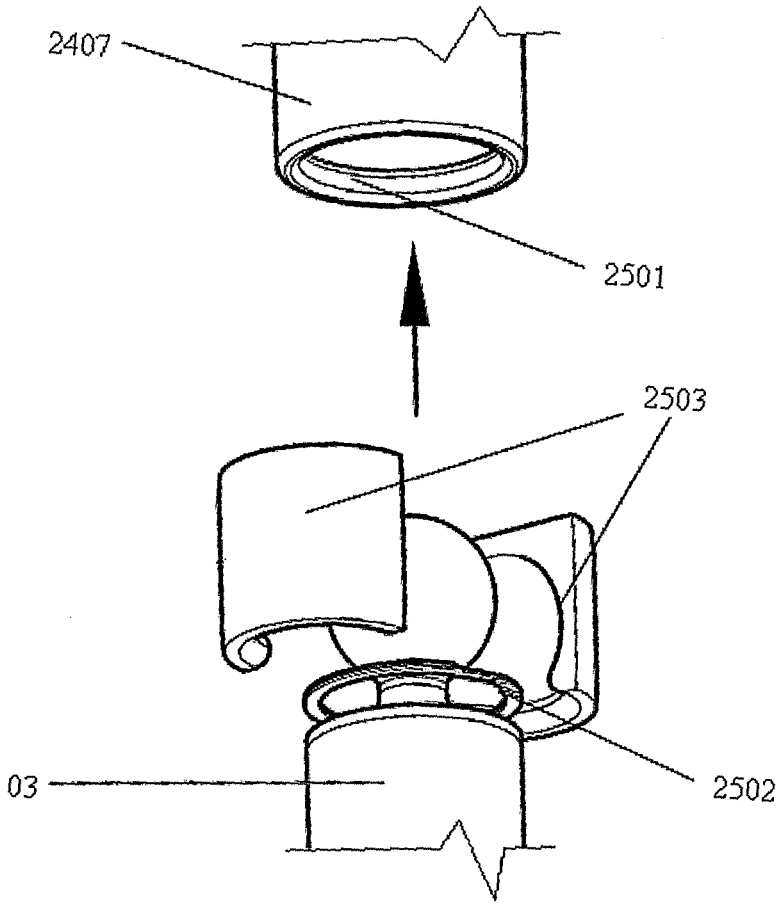
FIG. 31 is a diagrammatic representation of a ringed spinner bottom portion and footer connection.

FIG. 31 is a diagrammatic representation of one embodiment, not by limitation, of a connection between a ring assembly bottom portion 2407 and a ring assembly footer element 2403. Portion 2407 illustratively includes a spiral retainer groove 2501. Footer 2403 includes a spiral retainer 2502. In one embodiment, retainer 2502 is inserted into groove 2501 and the bottom ring assembly portion and ring assembly footer are secured together utilizing bushings 2503.

Figure 32:
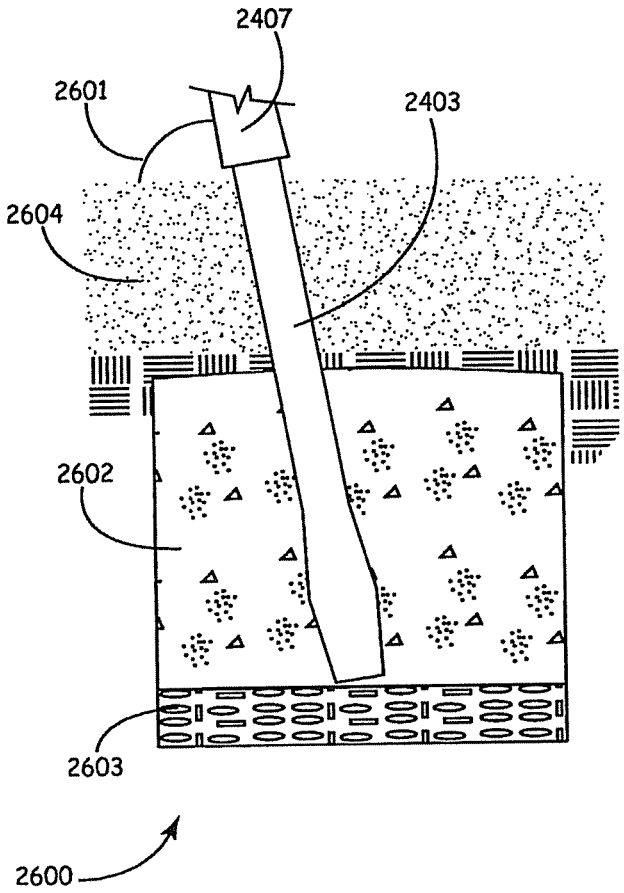
FIG. 32 is a side view of a ringed spinner footing.

FIG. 32 is a side view of a ringed spinner footing 2600 illustratively utilized to support the end of a ringed spinner in order to secure the structure to the ground. This is but one example of an appropriate footing to which the scope of the present invention is not limited. In footing 2600, the ring assembly bottom 2407 and ring assembly footer 2403 are secured together and are tilted at an angle 2601 (e.g., eighty degrees) from the surface of the ground. Footer 2403 is encased by a cylindrical concrete footing 2602 (e.g., height of at least 20 inches and a minimum diameter of 12 inches), and footing 2602 rests upon crushed rock 2603 (at least 3 inches). In one embodiment, the concrete footing is covered with loose fill material 2604.

Figure 33:
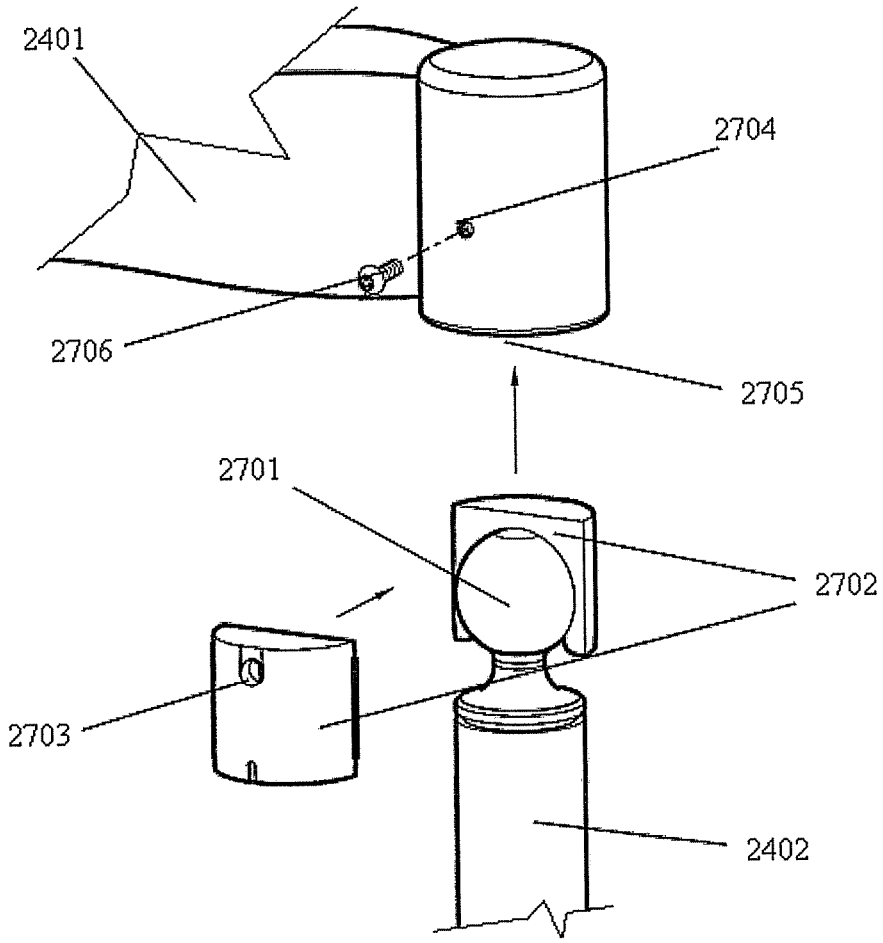
FIG. 33 is a diagrammatic representation of a ringed spinner upper spinner mount and ring assembly connection.

FIG. 33 is a diagrammatic representation of one embodiment, not by limitation, of a connection between a ringed spinner upper spinner mount 2401 and ring assembly 2402. The connection secures the two components together while allowing the ring assembly to rotate. Ring assembly 2402 includes a spherical attachment 2701 that is enclosed by bushings 2702. Bushings 2702 are configured to receive a screw on the outer portion 2703. Upper spinner mount 2401 is configured to receive a screw at portion 2704 and to receive the bushings at portion 2705. The bushings with the spherical attachment enclosed is inserted into portion 2705 and secured to the spinner mount by a connection mechanism such as but not limited to the illustrated screw 2706. It should be noted that the connection scheme shown and discussed above in relation to FIG. 31 is somewhat similar to that shown in FIG. 33. In one embodiment, either scheme can be used in either case (i.e., both schemes will work for both elements).

Ringed spinner 2400 can be used in many different ways. For example, one could stand on the ground and spin the ring assembly around. One could also support him or herself on the ring assembly and rotate back-and-forth. These are simply two of many play options that will be apparent to those skilled in the art.

Figure 34:
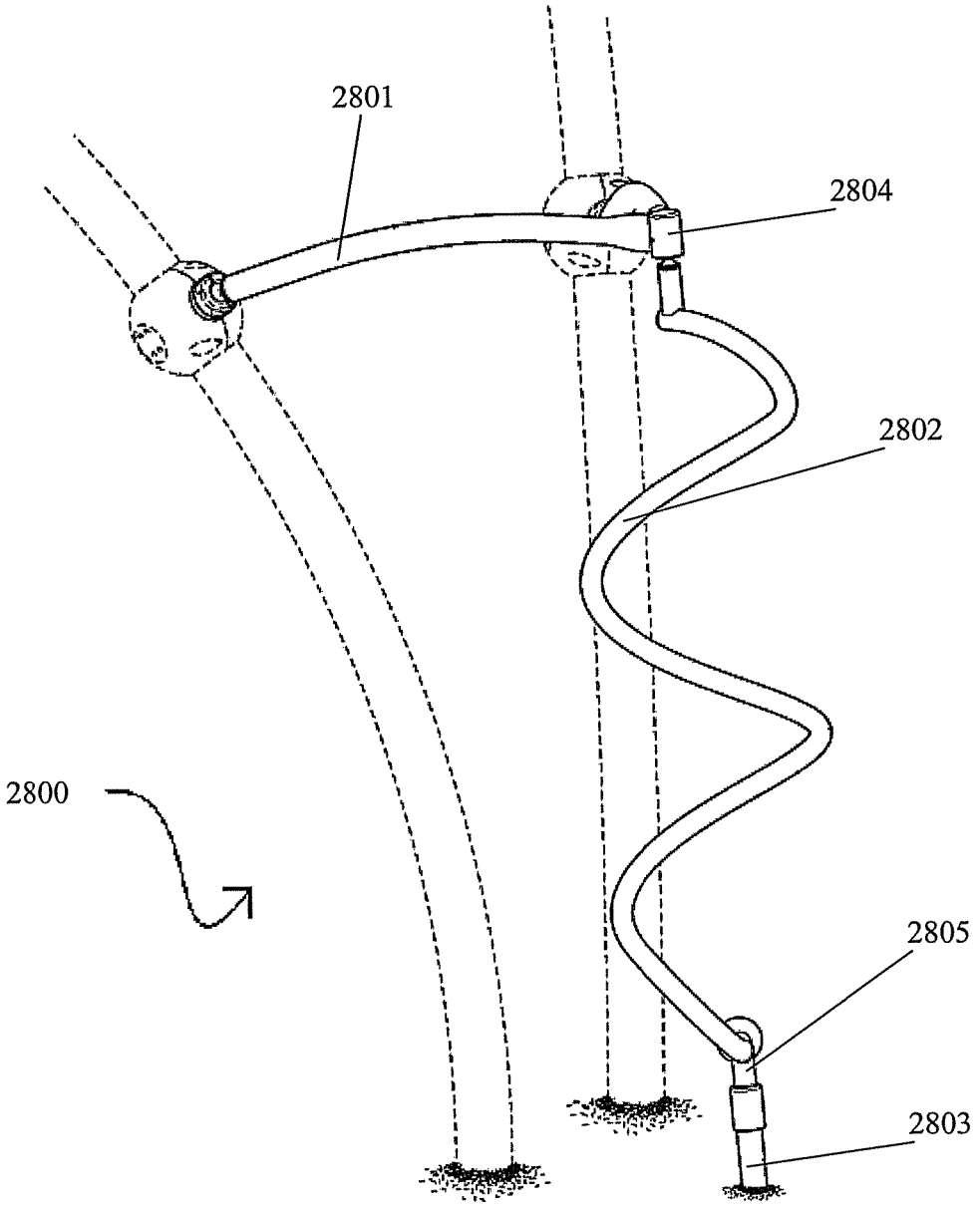
FIG. 34 is a perspective view of a spiral spinner.

FIG. 34 is a perspective view of another example of a play element that can be incorporated into system 100. The play element in FIG. 34 is a spiral spinner 2800. Spiral spinner 2800 includes an upper spinner mount 2801, a spiral assembly 2802, and a footer 2803. The upper spinner mount includes two bars joined together in a "V" shaped fashion.

The two top ends of the "V" each include an attachment for connection to an arch assembly. In one embodiment, the attachments are consistent with the attachment scheme described in relation to FIG. 10. The bottom of the "V", portion 2804, is configured to support the spiral assembly in such a way as to allow the spiral assembly to rotate. The ring assembly bottom end 2805 and footer 2803 are configured to be secured together in such a way that the spiral assembly can rotate. In one embodiment, end 2805 and footer 2803 are secured together in a manner that is same or similar to the scheme described above in relation to FIG. 31, and the footer is mounted in a manner that is same or similar to the scheme described above in relation to FIG. 32. Also in an embodiment, upper spinner mount 2801 and spiral assembly 2802 are secured together in a manner that is same or similar to the scheme described above in relation to FIG. 33.

Spiral spinner 2800 can be used in many different ways. For example, one could stand on the ground and spin the ring assembly around. One could also support him or herself on the ring assembly and rotate back-and-forth. These are simply two of many play options that will be apparent to those skilled in the art.

In addition to play elements attached to one or more arch assemblies, an arch-based play system may also include additional play elements in the environment that are not necessarily attached to an arch assembly. These "unattached" play elements contribute to creating a continuous and innovative play system. Several illustrative embodiments of such play elements are described below.

Figure 35:
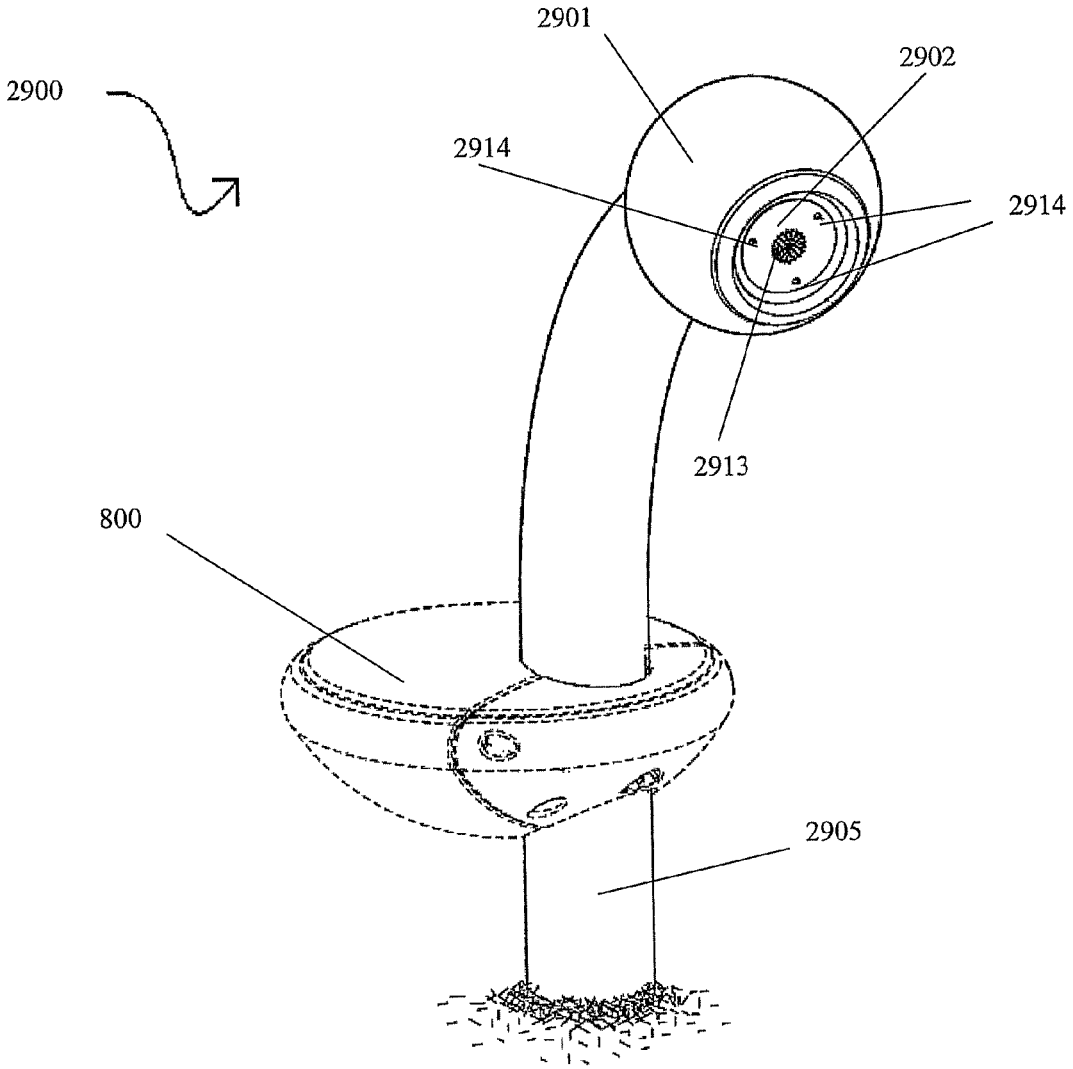
FIG. 35 is a perspective view of a talking post.
Figure 36:
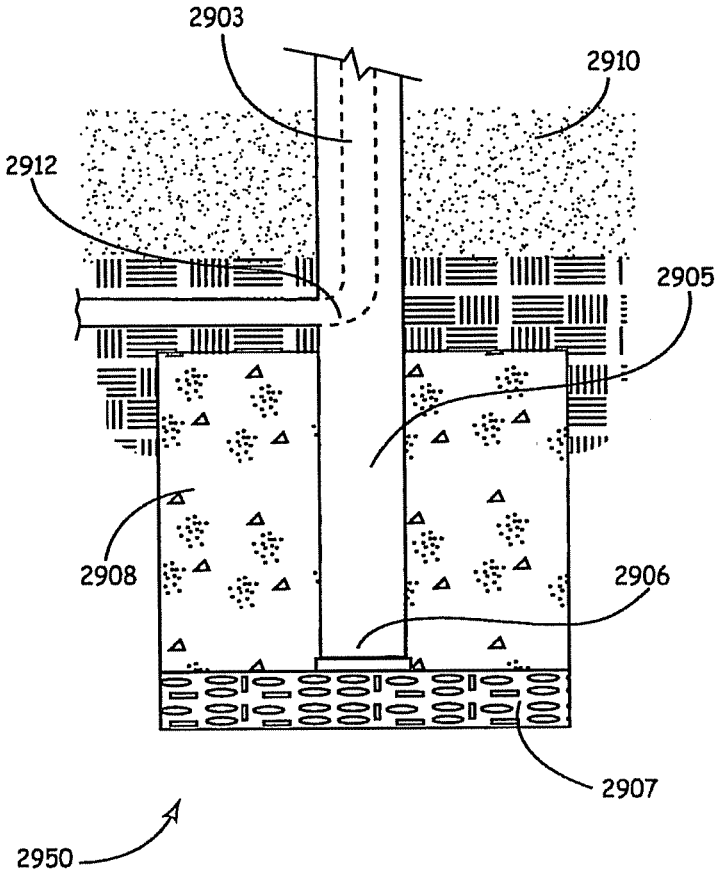
FIG. 36 is a schematic representation of a talking post footing scheme.

FIG. 35 is a perspective view of an example of an "unattached" play element that can be incorporated into system 100. The play element in FIG. 35 is a talking post 2900. FIG. 36 is a side view of a bottom portion 2950 of talking post 2900. Talking post 2900 includes a talking ball 2901, a talking ball plate 2902, a talking tube hose 2903, and a post 2905. The bottom of the talking post 2906 is positioned upon crushed rock 2907 and is encased in a cylindrical concrete footing 2908. In one embodiment, concrete footing 2908 is covered by a covering 2910.

Talking post 2900 includes an aperture 2912 located above the concrete footing in which talk tube hose 2903 can exit. Talking ball plate 2902 includes openings in the plate 2913 to permit sound waves to enter and leave the talking tube hose, and also includes apertures 2914 so that the plate can be secured to the talking ball utilizing a connection mechanism such as, but not necessarily limited to, screws or bolts (not shown).

In one embodiment of a talking post, a stepping surface 800 is secured to a talking post. In another embodiment, two talking post share a talk tube such that sound waves can travel from one talking post to the other. Talking post 2900 can be used in many different ways. For example, if two talking posts share a talk tube, users can speak into one talking post and be heard at the other. This is but one of many play options that will be apparent to those skilled in the art.

Figure 37:
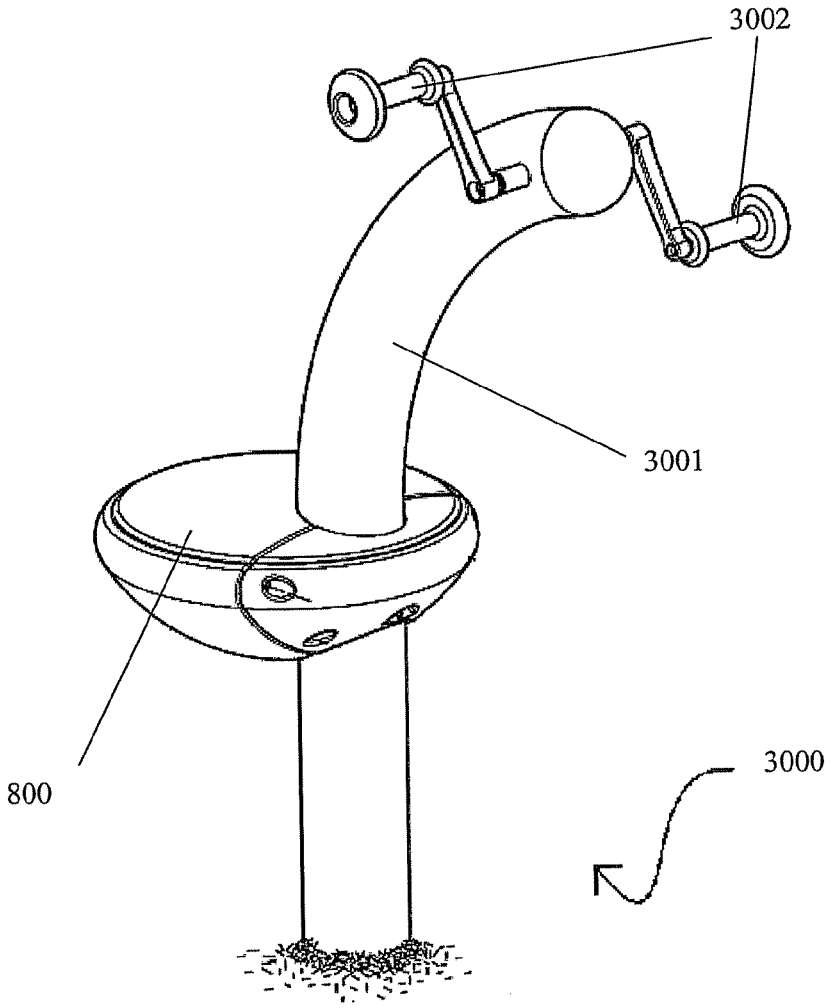
FIG. 37 is a perspective view of a cycler.
Figure 38:
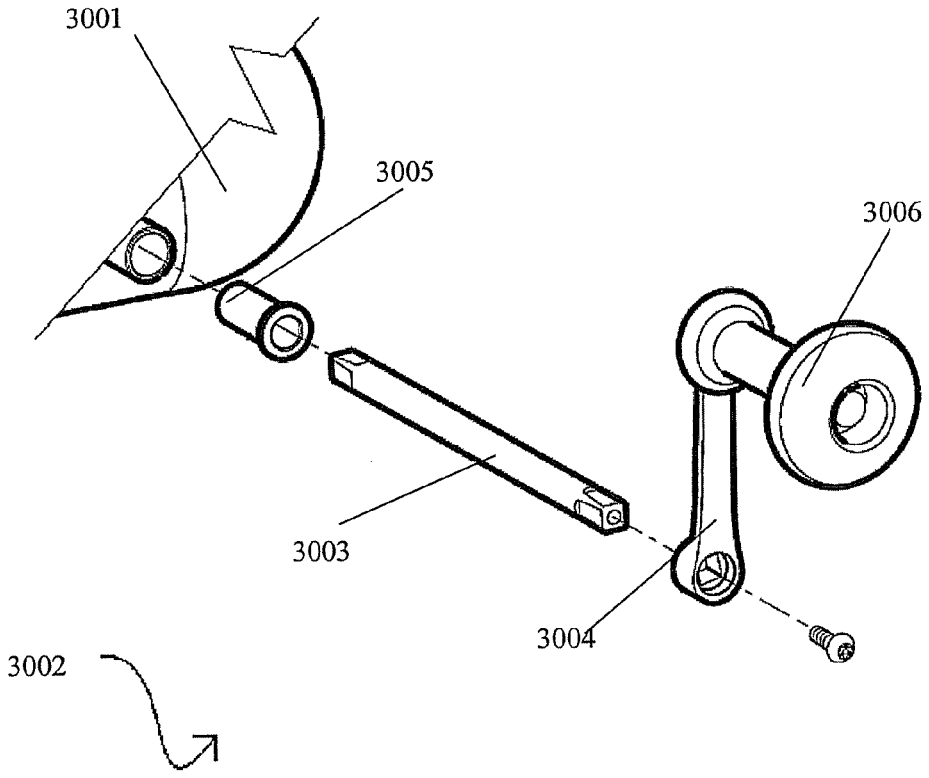
FIG. 38 is an exploded view of a cycler handhold assembly.

FIG. 37 is a perspective view of another example of a play element that can be incorporated into system 100. The play element in FIG. 37 is a cycler 3000. Cycler 3000 includes a cycler post 3001 and two handhold assemblies 3002. FIG. 38 is an exploded view of an embodiment of a cycler handhold assembly 3002. Handhold assembly 3002 includes a shaft 3003, a crank 3004, bushings 3005, and handles 3006. Handhold assemblies 3002 are mounted in such a way that the handles can be rotated in a manner similar to as how bicycle pedals are rotated. In one embodiment, the bottom of the talking post sits upon crushed rock and is encased in a cylindrical concrete footing.

In one embodiment, a stepping surface 800 is attached to cycler post 3001 in such a manner that the stepping surface surrounds the cycler post, and that a child can stand on the stepping surface. Cycler 3000 can be used in many different ways. For example, a child can stand on an attached stepping surface and rotate the handhold assemblies with his/her hands. This is but one of many play options that will be apparent to those skilled in the art.

Figure 39:
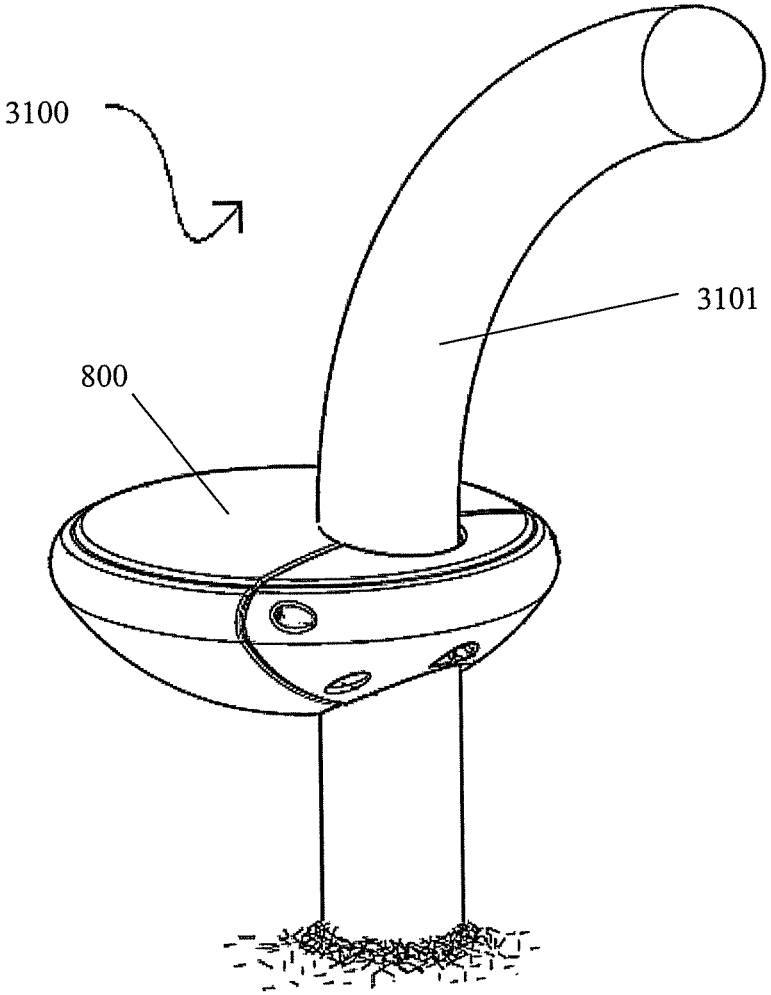
FIG. 39 is a perspective view of a curved post.

FIG. 39 is a perspective view of another example of a play element that can be incorporated into system 100. The play element in FIG. 39 is a curved post 3100. Curved post 3100 includes a post member 3101. In one embodiment, post member 3101 is constructed from an aluminum tube. In one embodiment, the curved post sits upon crushed rock and is encased in a cylindrical concrete footing.

In another embodiment, the curved post includes one or two stepping surfaces 800 attached to post member 3101. These stepping surfaces could be used to stand on, and elevate from the ground when playing with the curved post. Curved post 3100 can be used in many different ways. For example, a user can hold onto the post and rotate around the post. This is but one of many play options that will be apparent to those skilled in the art.

Figure 40:
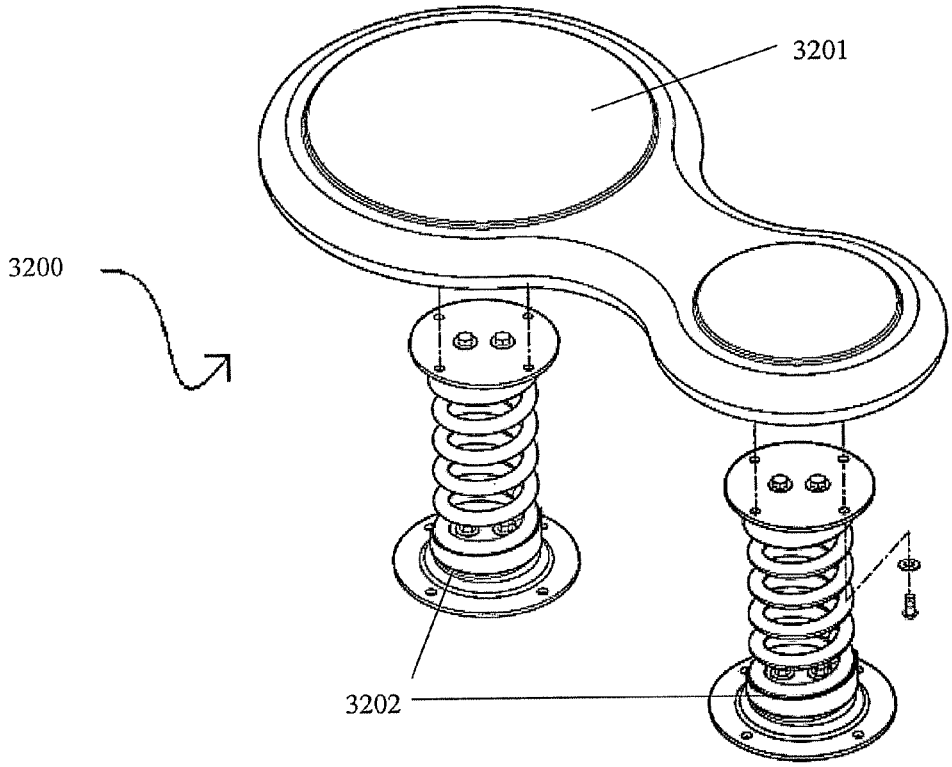
FIG. 40 is an exploded view of a spring bench.

FIG. 40 is an exploded view of another example of a play element that can be incorporated into system 100. The play element in FIG. 40 is a spring bench 3200. Spring bench 3200 includes a platform 3201 upon which children can support themselves. In one embodiment of a spring bench, platform 3201 has the approximate shape of two circles joined with one of the circles being larger than the other. Platform 3201 is supported by two spring assemblies 3202 that allow the platform to move in a manner consistent with spring action such as oscillating and dampening.

Spring bench 3200 can be used in many different ways. For example, a user can sit on the platform and bounce up-and-down or swing from side-to-side. This is but one of many play options that will be apparent to those skilled in the art.

Figure 41:
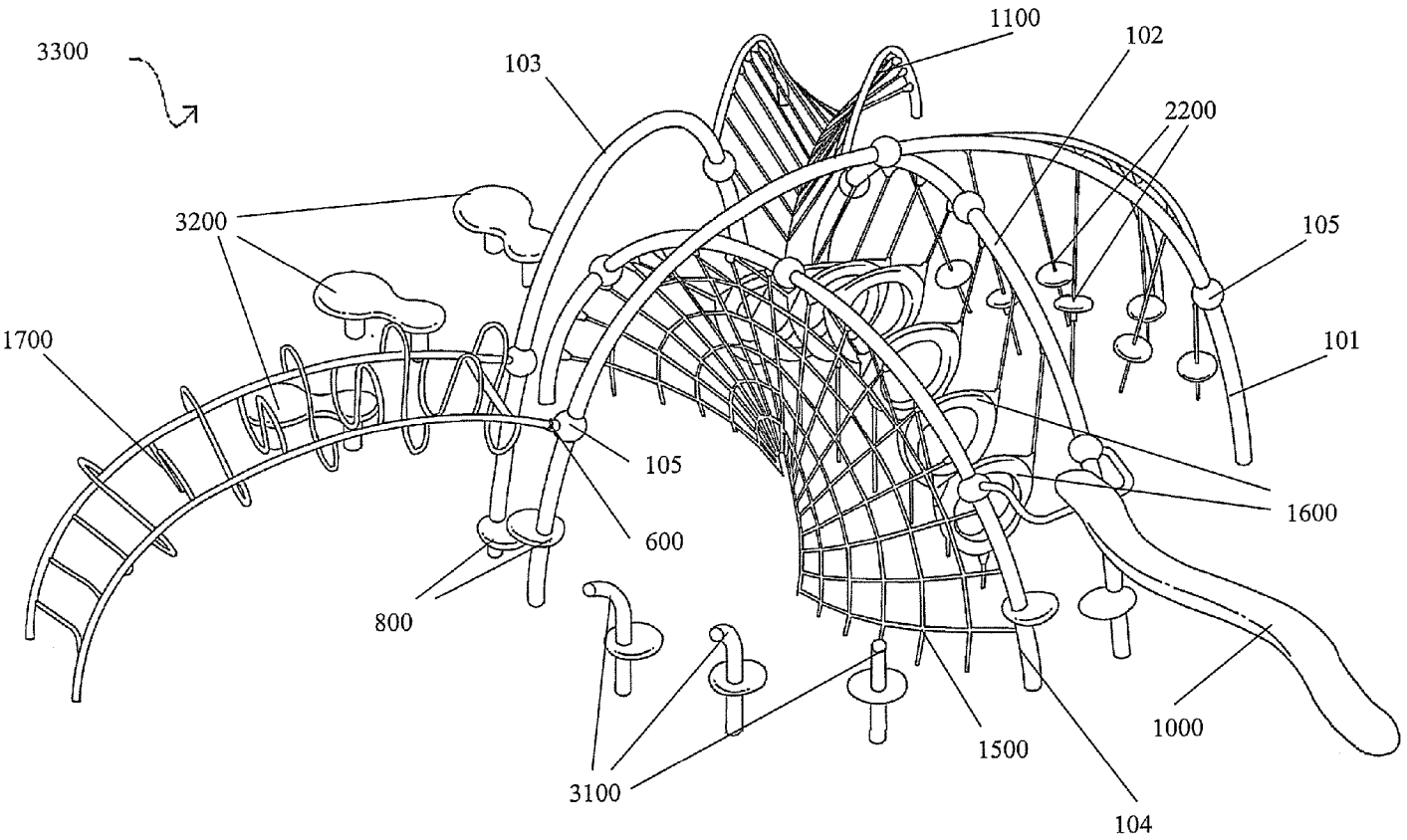
FIG. 41 is a perspective view of one embodiment of an arch-based play system with integrated play elements.

FIG. 41 is a perspective view of an embodiment of an arch-based play system 3300. System 3300 combines many of the components discussed above. System 3300 includes four arch assemblies 101, 102, 103, 104, arch clamps 105 (an illustrative two are identified in FIG. 41), ball clamps 600 (an illustrative one is identified in FIG. 41), spring benches 3200, a pipe climber 1700, stepping surfaces 800 (an illustrative two are identified in FIG. 41), curved posts 3100, a climbing net 1500, a winding slide 1000, climbing rings 1600, a cable-disk climber 2200, and a cable rope climber 1100. It is worth noting that system 3300 is a composite play structure. A composite play structure is two or more play structures attached or functionally linked, to create one integral unit that provides more than one play activity.

System 3300 provides numerous routes in which children can go almost seamlessly from one play element and experience to another. This variety of routes and continuity in play provides an alternate experience to children accustomed to the "post and deck" style of other play systems. An example of a route is that a child could start on the spring benches, travel from the end of the pipe climber towards the center of system, transfer from the pipe climber to the stepping surfaces below, travel from the stepping surfaces to the curved post, travel from the curved post to the climbing net, travel across the climbing net and transfer to the climbing rings, crawl through the climbing rings, and finally slide down the winding slide. Many, many other potential routes exist in the system in which the child can go from one play experience to another without interruption.

Figure 42:
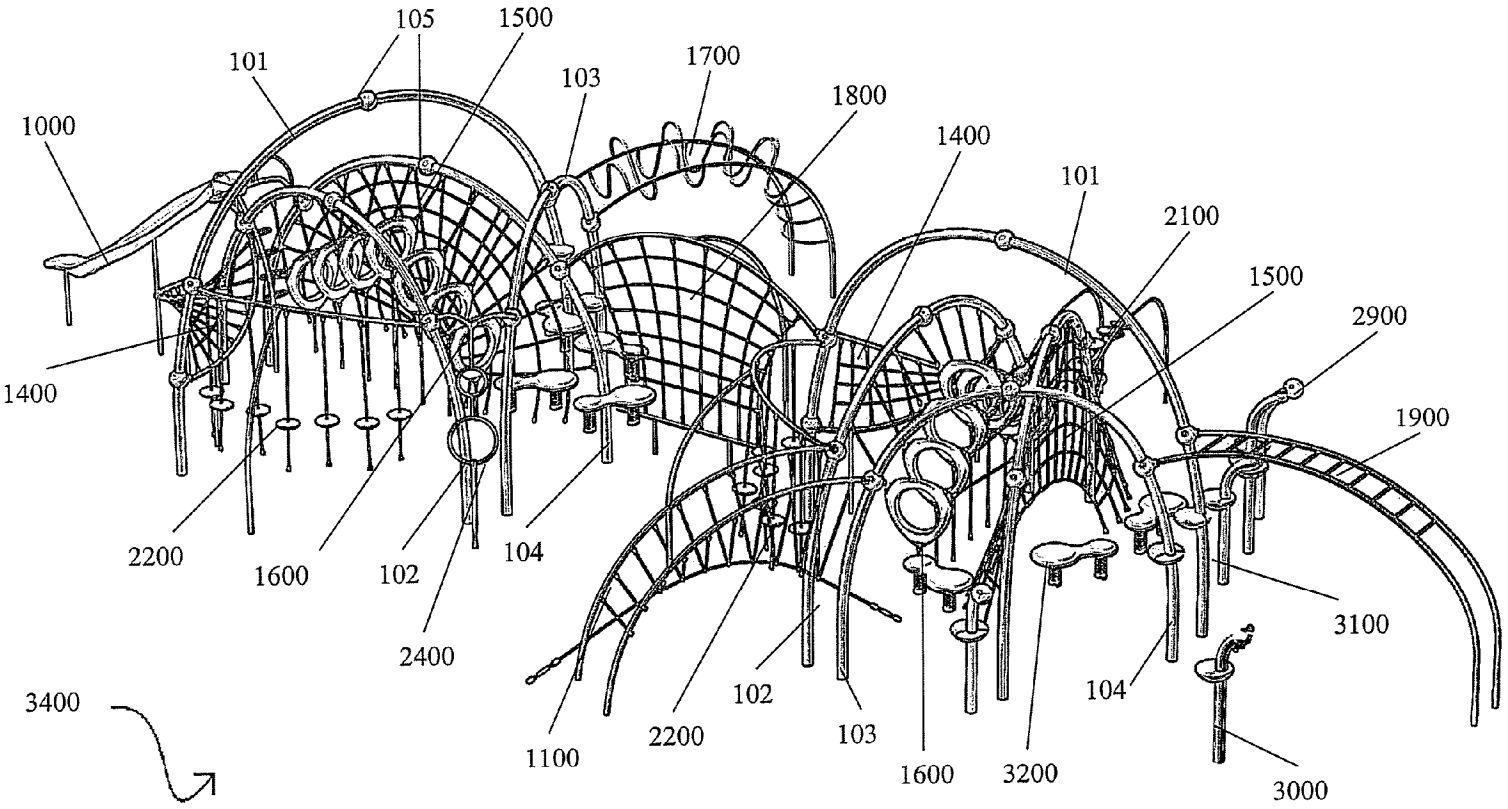
FIG. 42 is a perspective view of another embodiment of an arch-based play system.

FIG. 42 is a perspective view of an embodiment of an arch-based play system 3400. System 3400 includes eight arch assemblies 101, 102, 103, 104, arch clamps 105 (an illustrative two are identified in FIG. 42), a winding slide 1000, two twisted nets 1400, a cable-disk climber 2200, two climbing rings assemblies 1600, a ringed spinner 2400, cable rope climber 1100, spring benches 3200 (an illustrative one is identified in FIG. 42), a climbing rings assembly 1600, two talking posts 2900, a cycler 3000, a curved post 3100, an arched bar structure 1900, two climbing nets 1500, a pivoting walk-across 2100, a rope climbing structure 1800, and a pipe climber 1700.

Similar to system 3300, system 3400 provides a wide variety of routes in which to transfer from one play element to the next. Also like in system 3300, this large variety of routes creates an entirely new play experience for children. An example of a play route in system 3400 is that a child can climb up the arched bar structure, jump onto a curved post, hop to a spring bench, grab onto the adjacent climbing net and work his or herself across, jump on to a talking post, transfer to the spring bench, pull his or herself into the climbing rings and climb through, pull his or herself across the adjacent twisted net, transfer and cross the climbing net, grab onto a pipe climber bar and climb his or herself back down to the ground.

It should be noted that systems 3300 and 3400 are only example configurations. The arch-based play system components such as, but not limited to, arch assemblies, arch clamps, ball clamps, and play elements can be used to create many possible configurations of the arch-based design.

Further, it should be pointed out that the arch-based system can be implemented in phases. For example, an initial system may only have two arches. An additional two arches can be added subsequently to enable different designs within the environment. Also, any number of arches could be added to the system to enable even more possibilities. The entire system is completely extensible, and the arch assemblies are the core of that extensibility.

Figure 43:
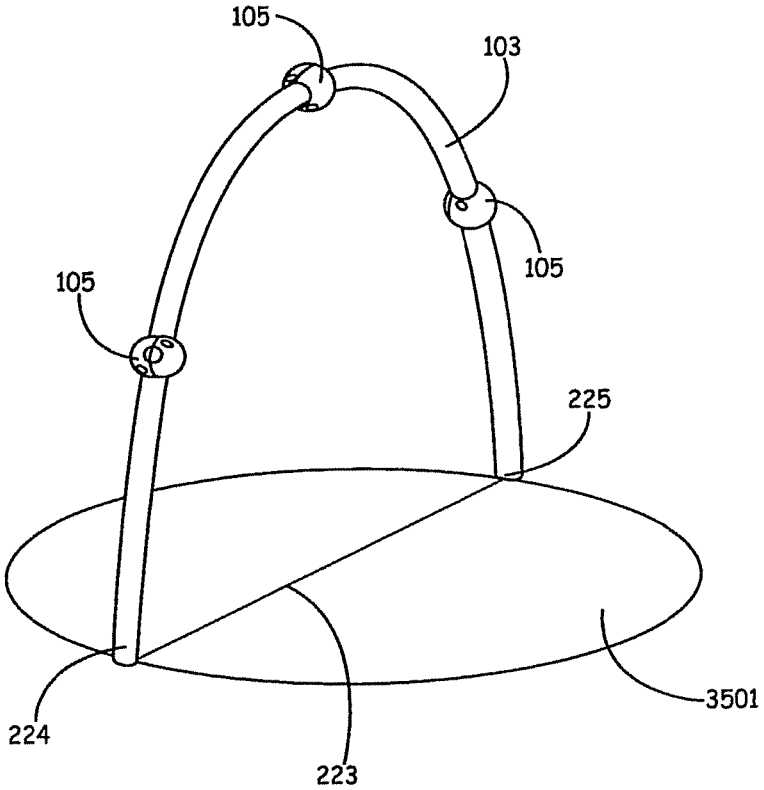
FIG. 43 is a perspective view of an arch assembly and an imaginary circle.

FIG. 43 is a perspective view of an arch assembly and an imaginary circle. Arch assembly 103 lies in the same plane as the plane created by the three arch clamps 105. Imaginary circle 3501 is perpendicular to the arch assembly plane. The diameter of the circle is the distance 223 between the first end of the arch assembly 224 and the second end of the arch assembly 225. Ends 224 and 225 lie on opposing sides of the circumference of circle 3501. In an embodiment, all arch assemblies in a play system each lie in their own plane and have imaginary circles. The imaginary circles are perpendicular to the plane of their associated arch and have diameters equal to the distance between the first end of the associated arch and the second end of the associate arch. In one embodiment, the imaginary circles formed by arch assemblies in a play system all lie in the same plane. In another embodiment, the imaginary circles formed by arch assemblies in a play system lie in different planes (i.e. arch assembly planes are not perpendicular to the ground).

It is worth noting that in an embodiment such as that shown in FIG. 43, play elements can be attached to an arch assembly and extend beyond the arch assembly's imaginary circle. For example, play element 1700 in FIG. 41 extends beyond the imaginary circles of the arch assemblies 101 and 103. Similarly in FIG. 41, play elements 1000, 1100, and 2200 extend beyond the imaginary circles of their attached arch assemblies.

Figure 44:
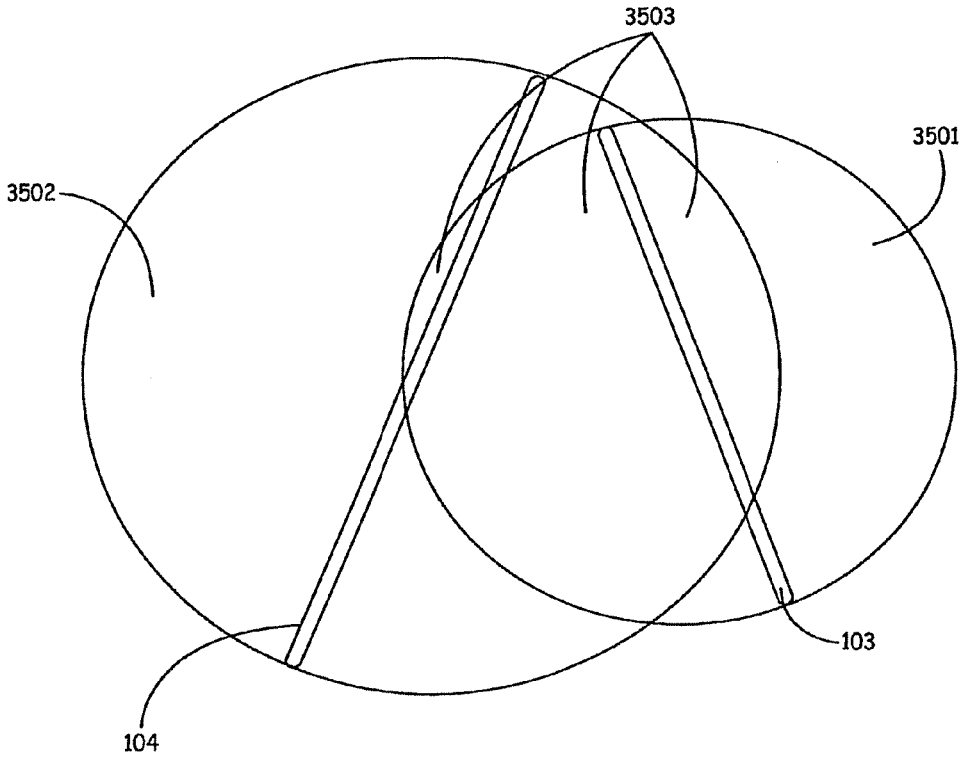
FIG. 44 is a top view of two arch assemblies and their imaginary circles.

FIG. 44 is a top view of two arch assemblies and their imaginary circles. Arch assembly 103 has its imaginary circle 3501, and arch assembly 104 has its imaginary circle 3502. It is noteworthy that circles 3501 and 3502 overlap (i.e. they share some area in common). The overlapping area is labeled 3503. In an embodiment, two or more arch assemblies in a play system have imaginary circles that are perpendicular to the arches and the imaginary circles of each arch at least partially overlap such that there is an area common to all imaginary circles. In another embodiment, the imaginary circles are not in the same plane and the overlapping area between the two imaginary circles is more or less a line.

Figure 45:
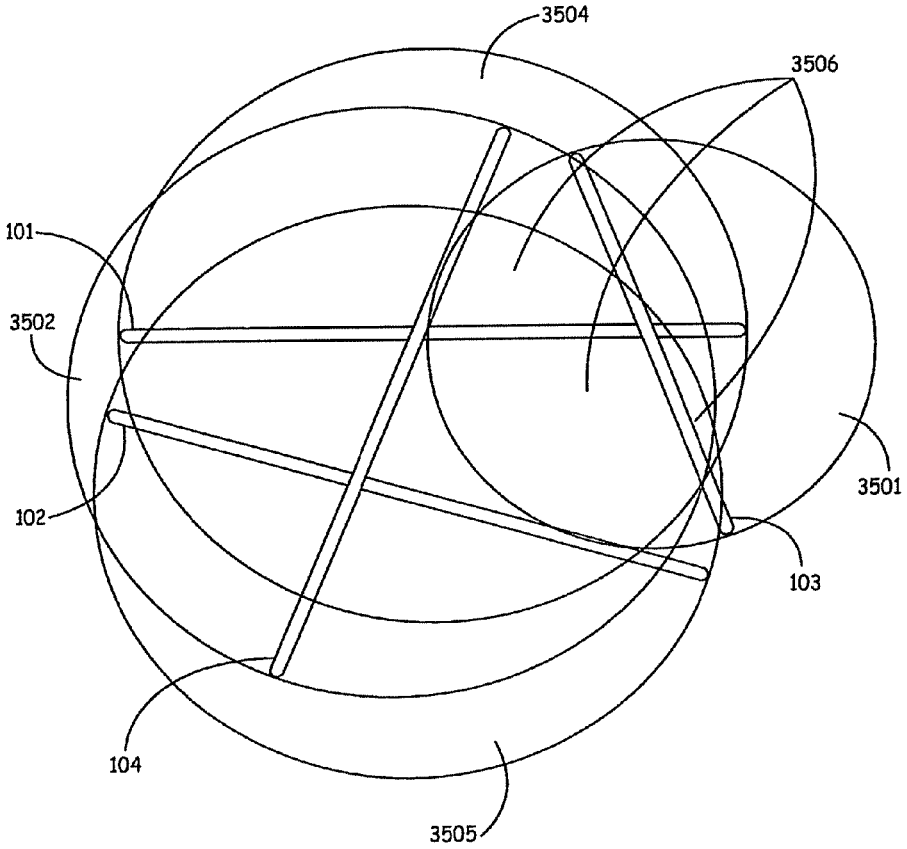
FIG. 45 is a top view of four arch assemblies and their imaginary circles.

FIG. 45 is a top view of four arch assemblies and their imaginary circles. Arch assembly 103 has its imaginary circle 3501, arch assembly 104 has its imaginary circle 3502, arch assembly 101 has its imaginary circle 3504, and arch assembly 102 has its imaginary circle 3505. It is noteworthy that circles 3501, 3502, 3504, and 3505 overlap (i.e. they share some area in common). This overlapping area is labeled 3506.

Figure 46:
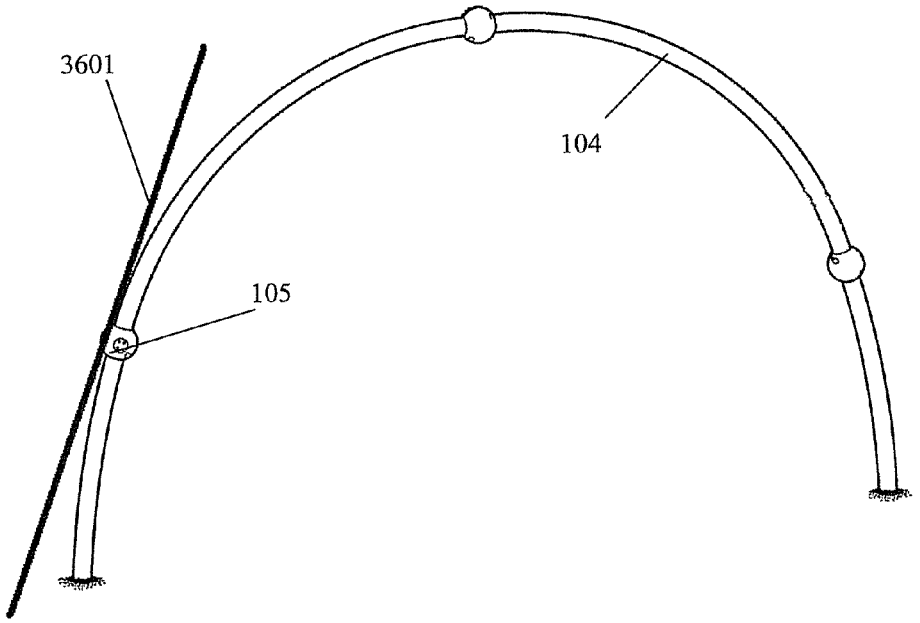
FIG. 46 is a perspective view of an arch assembly and an imaginary line.

FIG. 46 is a perspective view of an arch assembly 104 and an imaginary line 3601. Line 3601 is tangential to the arch assembly 104 at the ball clamp attachment point 105. The imaginary line 3601 is not perpendicular to the ground. It is angled. This illustrates that at the attachment point the arch is at an angle other than perpendicular.

It is worth noting some of the functionality of some of the features already discussed. Some of the features of embodiments disclosed are arch assemblies having an incomplete circle or oval shape, arch assemblies of different heights, arch assemblies at angles other than parallel or perpendicular to each other, arch assemblies orientated towards each other such that they have overlapping imaginary circles, arch assemblies where attachment points are at arch locations that are not perpendicular to the ground, overlapping arch assemblies, and arch assemblies having end to end distances spaced apart by a distance of at least six feet. All of these features, and others not listed, contribute utility to play systems. Many of the features in addition to having utility when used alone, also contribute additional utility to a system when used in combination. For example, the incomplete circle or oval shapes such as those shown in FIGS. 19-22 utilize the shape to create the layout and size of play environments. The end to end distance of at least six feet allows for play environments such as those shown in FIG. 28 and allows for people to pass under the arch assemblies. The overlapping arch assemblies and overlapping imaginary circles allow for play elements to be located proximate to each other such that a user can pass from one play element to another, and also for play elements to be attached to more than one arch assembly. Arch assemblies with different heights and arches at angles other than perpendicular allow for play elements to be attached to more than one arch and allow for play elements to be located proximate to each other such that a user can pass from one to another. Attachment points at arch assembly portions not perpendicular to the ground allow for better accessibility to play elements by allowing multiple play elements to be located proximate to each other such that a user can easily pass from one play element to another. The not perpendicular attachments also facilitate attaching a play element to more than one arch assembly.

Although the arch-based play system has been described with reference to particular embodiments, workers skilled in the art will recognize that changes may be made in form and detail without departing from the spirit and scope of the invention.

What is claimed is:

1. A play system comprising:

a first overhang having a first end and a second end;

a second overhang having a first end and a second end;

a third overhang having a first end and a second end;

a fourth overhang having a first end and a second end, wherein the first, the second, the third, and the fourth overhangs are approximately vertically oriented relative to a surface such that the first ends of the overhangs contact the surface and the second ends of the overhangs are above the surface;

a first play element having a first arch component and a second arch component, each of the first and the second arch components including a first end, a second end, and a rigid stationary member that extends between its first and second ends, the first end of the first arch component being connected to the first overhang, the first end of the second arch component being connected to the second overhang, the second ends of the first and the second arch components being supported by connections to the surface, the first play element further having crossbars that extend between the rigid stationary members of the first and the second arch components; and a second play element having a plurality of climbing rings that are supported by the third overhang and by the fourth overhang.

2. The play system of claim 1, wherein at least two of the overhangs are located entirely within one plane, and wherein the crossbars of the first play element comprise sinusoidal-like crossbars.

3. The play system of claim 1, wherein the first and the second overhangs are located within a first plane, wherein the third and the fourth overhangs are located within a second plane, and wherein the play system further comprises:

a third play element having a plurality of rounded platform assemblies that are suspended vertically by connections to at least some of the overhangs.

4. The play system of claim 3, wherein the first and the second planes are approximately perpendicular to the surface, and wherein the play system further comprises a plurality of posts that are supported through connections to the surface, each of the posts including a stepping surface that surrounds an outer surface of the associated post.

5. The play system of claim 4, wherein at least To of the second ends are connected together, and wherein the play system further comprises:

a fourth play element having a support bar that suspends a net and that is supported by connections to at least two of the overhangs.

6. The play system of claim 5, and further comprising:

a fifth play element having a rounded bench portion that is supported by a spring assembly that enables the rounded bench portion to move in an oscillating manner.

7. The play system of claim 1, wherein each of the overhangs has a different height.

8. The play system of claim 5, wherein at least two of the play elements are connected to the surface utilizing underground turnbuckle assemblies.

* * * * *